US009316420B2

(12) United States Patent
Yamashita et al.

(10) Patent No.: US 9,316,420 B2
(45) Date of Patent: Apr. 19, 2016

(54) AIR-CONDITIONING APPARATUS

(75) Inventors: Koji Yamashita, Tokyo (JP); Hiroyuki Morimoto, Tokyo (JP); Takeshi Hatomura, Tokyo (JP); Shinichi Wakamoto, Tokyo (JP); Naofumi Takenaka, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 639 days.

(21) Appl. No.: 13/501,184

(22) PCT Filed: Oct. 28, 2009

(86) PCT No.: PCT/JP2009/068455

§ 371 (c)(1),
(2), (4) Date: Apr. 10, 2012

(87) PCT Pub. No.: WO2011/052046

PCT Pub. Date: May 5, 2011

(65) Prior Publication Data

US 2012/0192588 A1 Aug. 2, 2012

(51) Int. Cl.
*F25B 1/00* (2006.01)
*F25B 13/00* (2006.01)
(Continued)

(52) U.S. Cl.
CPC ..... *F25B 13/00* (2013.01); *F25B 25/005* (2013.01); *F25B 49/027* (2013.01);
(Continued)

(58) Field of Classification Search
CPC ..... F25B 29/003; F25B 30/02; F25B 2313/02323; F25B 2400/0403; F25B 2600/19; F25B 2600/13; F25B 2700/21163; F25B 13/00; F25B 25/005; F25B 2313/006; F25B 2313/0272; F25B 2313/02741; F25B 49/027; F25B 2313/023; F25B 2313/0252; F25B 2400/04
USPC ..... 62/196.4, 324.6, 324.1, 498
See application file for complete search history.

(56) References Cited

U.S. PATENT DOCUMENTS 5,388,422 A 2/1995 Hayashida et al.
5,526,650 A * 6/1996 Iritani et al. ..... 62/205
(Continued)

FOREIGN PATENT DOCUMENTS

JP 5-280818 A 10/1993
JP 8-291952 A 11/1996
(Continued)

OTHER PUBLICATIONS

Office Action (Notice of Reasons for Rejection) dated Jun. 25, 2013 issued in corresponding Japanese Patent Application No. 2011-538147, and an English translation thereof.
(Continued)

*Primary Examiner* — Ljiljana Ciric
*Assistant Examiner* — Kirstin Oswald
(74) *Attorney, Agent, or Firm* — Buchanan Ingersoll & Rooney PC

(57) ABSTRACT

An air-conditioning apparatus including a refrigerant circuit having an excess refrigerant recovery pipe connected between an inlet of at least one of heat source side heat exchangers and a first refrigerant flow blocking device or between an outlet of the at least one of the heat source side heat exchangers and a second refrigerant flow blocking device, to a passage connected to a suction side of a compressor, and an excess refrigerant recovery device disposed in the excess refrigerant recovery pipe.

12 Claims, 11 Drawing Sheets

(51) Int. Cl.
*F25B 25/00* (2006.01)
*F25B 49/02* (2006.01)

(52) U.S. Cl.
CPC .... *F25B 2313/006* (2013.01); *F25B 2313/023* (2013.01); *F25B 2313/0252* (2013.01); *F25B 2313/0272* (2013.01); *F25B 2313/02741* (2013.01); *F25B 2400/04* (2013.01)

(56) References Cited

U.S. PATENT DOCUMENTS

| | | | | |
|---|---|---|---|---|
| 5,878,589 | A * | 3/1999 | Tanaka et al. | 62/199 |
| 2002/0194857 | A1 | 12/2002 | Kato et al. | |
| 2003/0230096 | A1* | 12/2003 | Hwang | 62/160 |
| 2003/0233835 | A1* | 12/2003 | Tomita et al. | 62/133 |
| 2004/0134215 | A1* | 7/2004 | Park et al. | 62/324.1 |
| 2006/0048539 | A1* | 3/2006 | Takechi et al. | 62/513 |
| 2006/0254294 | A1* | 11/2006 | Shimamoto et al. | 62/238.7 |
| 2007/0022777 | A1* | 2/2007 | Takegami et al. | 62/498 |
| 2007/0251265 | A1* | 11/2007 | Kurata et al. | 62/513 |
| 2009/0126399 | A1* | 5/2009 | Takegami | 62/510 |
| 2009/0145151 | A1* | 6/2009 | Wakamoto et al. | 62/259.1 |
| 2010/0293975 | A1* | 11/2010 | Kawano et al. | 62/149 |

FOREIGN PATENT DOCUMENTS

| | | | |
|---|---|---|---|
| JP | 10-325589 | A | 12/1998 |
| JP | 10-325641 | A | 12/1998 |
| JP | 2000-346488 | A | 12/2000 |
| JP | 2001-289465 | A | 10/2001 |
| JP | 2002-106995 | A | 4/2002 |
| JP | 2003-4326 | A | 1/2003 |
| JP | 2003-343936 | A | 12/2003 |
| JP | 2004-226015 | A | 8/2004 |
| JP | 2005-140444 | A | 6/2005 |

OTHER PUBLICATIONS

*International Search Report (PCT/ISA/210) issued on Jan. 26, 2010, by Japanese Patent Office as the International Searching Authority for International Application No. PCT/JP2009/068455.

Office Action (Text Portion of the Second Office Action) issued on Sep. 17, 2014, by the Chinese Patent Office in corresponding Chinese Patent Application No. 200980162175X, and an English translation of the Office Action. (9 pages).

* cited by examiner

AIR-CONDITIONING APPARATUS

TECHNICAL FIELD

The present invention relates to an air-conditioning apparatus which is applied to, for example, a multi-air-conditioning apparatus for a building.

BACKGROUND ART

In an air-conditioning apparatus, such as a multi-air-conditioning apparatus for a building, refrigerant is circulated between an outdoor unit, functioning as a heat source unit, disposed outside, for example, a structure and an indoor unit disposed inside an indoor space of the structure. The refrigerant transfers heat or removes heat to heat or cool air, thus heating or cooling a conditioned space through the heated or cooled air. As regards the refrigerant, for example, an HFC (hydrofluorocarbon) refrigerant is often used. An air-conditioning apparatus using a natural refrigerant, such as carbon dioxide ($CO_2$), is also proposed.

Furthermore, in an air-conditioning apparatus called a chiller, cooling energy or heating energy is produced in a heat source unit disposed outside a structure. Water, antifreeze, or the like is heated or cooled by a heat exchanger disposed in an outdoor unit and it is carried to an indoor unit, such as a fan coil unit or a panel heater, to perform heating or cooling (refer to Patent Literature 1, for example).

Moreover, an air-conditioning apparatus called a waste heat recovery chiller is constructed such that a heat source unit is connected to each indoor unit through four water pipes arranged therebetween and, for example, cooled water and heated water are simultaneously supplied so that cooling or heating can be freely selected in the indoor unit (refer to Patent Literature 2, for example).

In addition, an air-conditioning apparatus is constructed such that a heat exchanger for a primary refrigerant and a secondary refrigerant is disposed near each indoor unit to carry the secondary refrigerant to the indoor unit (refer to Patent Literature 3, for example).

Furthermore, an air-conditioning apparatus is constructed such that an outdoor unit is connected to each branching unit including a heat exchanger through two pipes to carry a secondary refrigerant to an indoor unit (refer to Patent Literature 4, for example).

CITATION LIST

Patent Literature

Patent Literature 1: Japanese Unexamined Patent Application Publication No. 2005-140444 (Page 4, FIG. 1, for example)

Patent Literature 2: Japanese Unexamined Patent Application Publication No. 5-280818 (Pages 4 and 5, FIG. 1, for example)

Patent Literature 3: Japanese Unexamined Patent Application Publication No. 2001-289465 (Pages 5 to 8, FIGS. 1 and 2, for example)

Patent Literature 4: Japanese Unexamined Patent Application Publication No. 2003-343936 (Page 5, FIG. 1)

SUMMARY OF INVENTION

Technical Problem

In an air-conditioning apparatus of a related are, such as a multi-air-conditioning apparatus for a building, a refrigerant may leak into, for example, an indoor space because the refrigerant is circulated up to an indoor unit. On the other hand, in the air-conditioning apparatuses disclosed in Patent Literature 1 and Patent Literature 2, the refrigerant does not pass through the indoor unit. It is however required to heat or cool a heat transfer medium in a heat source unit disposed outside a structure and carry it to the indoor unit in the air-conditioning apparatuses disclosed in Patent Literature 1 and Patent Literature 2. Accordingly, a circulation path for the heat transfer medium is long. In this case, to carry heat for a predetermined heating or cooling work using the heat transfer medium, the amount of energy consumed for, for example, conveyance power is larger than that of the refrigerant. As the circulation path is longer, therefore, the conveyance power markedly increases. This indicates that energy saving is achieved as long as the circulation of the heat transfer medium can be properly controlled in an air-conditioning apparatus.

In the air-conditioning apparatus disclosed in Patent Literature 2, the four pipes have to be arranged to connect each indoor space to an outdoor unit so that cooling or heating can be selected in each indoor unit. Disadvantageously, there is little ease of construction. In the air-conditioning apparatus disclosed in Patent Literature 3, secondary medium circulating means, such as a pump, has to be provided to each indoor unit. Disadvantageously, the cost of such a system is high and also noise is large. This apparatus is not practical. In addition, since the heat exchanger is placed near each indoor unit, the risk of leakage of the refrigerant into a place near an indoor space cannot be eliminated.

In the air-conditioning apparatus disclosed in Patent Literature 4, a primary refrigerant that has been subjected to heat exchange flows into the same passage as that of the primary refrigerant to be subjected to heat exchange. In the case in which a plurality of indoor units is connected, it is difficult for each indoor unit to exhibit their maximum capacity. Such a configuration wastes energy. Furthermore, each branching unit is connected to an extension pipe through two pipes for cooling and two pipes for heating, i.e., four pipes in total. Consequently, this configuration is similar to that of a system in which the outdoor unit is connected to each branching unit through four pipes. Accordingly, there is little ease of construction in such a system.

The present invention has been made to overcome the above-described problem and provides an air-conditioning apparatus capable of achieving energy saving. The invention further provides an air-conditioning apparatus capable of achieving improvement of safety by not allowing refrigerant to circulate in or near an indoor unit. The invention further provides an air-conditioning apparatus that includes a reduced number of pipes connecting an outdoor unit to a branching unit (heat transfer medium relay unit) or an indoor unit to provide improved ease of construction, and can improve energy efficiency.

Solution to Problem

An air-conditioning apparatus according to the invention includes at least a compressor, a heat source side heat exchanger, a plurality of expansion devices, and a plurality of heat exchangers related to heat transfer medium that exchange heat between a heat source side refrigerant and a heat transfer medium, the compressor, the heat source side heat exchanger, the expansion devices, and refrigerant passages of the heat exchangers related to heat transfer medium being connected to form a refrigerant circuit through which the heat source side refrigerant is circulated, wherein the refrigerant circuit includes a bypass pipe that connects a point prior to and a point after the heat source side heat exchanger to bypass the heat source side heat exchanger and a heat source side refrigerant flow control device capable of controlling the ratio of the flow rate of the heat source side refrigerant flowing through the heat source side heat exchanger and that of the refrigerant flowing through the bypass pipe.

Advantageous Effects of Invention

Since the air-conditioning apparatus according to the invention includes the heat source side refrigerant flow control device capable of controlling the ratio of the flow rate of the heat source side refrigerant flowing through the heat source side heat exchanger and that of the refrigerant flowing through the bypass pipe, a reliably stabilized energy-saving operation can be achieved irrespective of a state of an operation performed by the air-conditioning apparatus.

DESCRIPTION OF EMBODIMENT

Embodiment of the invention will be described below with reference to the drawings.

Figure 1:
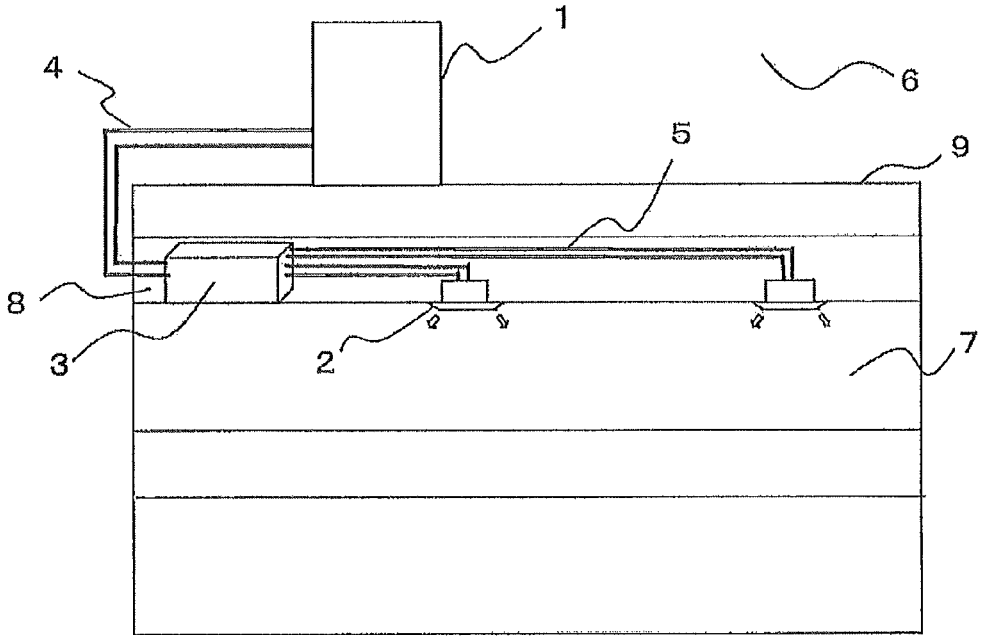
FIG. 1 is a schematic diagram illustrating an installation of an air-conditioning apparatus according to Embodiment of the invention.
Figure 2:
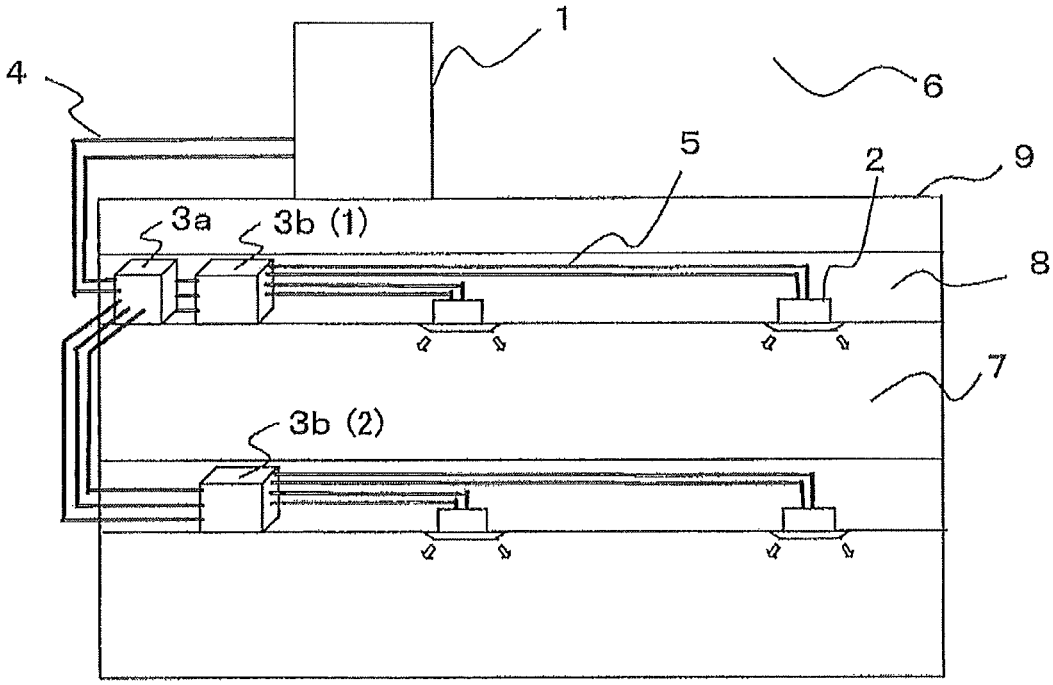
FIG. 2 is a schematic diagram illustrating an installation of the air-conditioning apparatus according to Embodiment of the invention.

FIGS. 1 and 2 are schematic diagrams illustrating installations of an air-conditioning apparatus according to Embodiment of the invention. The installations of the air-conditioning apparatus will be described with reference to FIGS. 1 and 2. This air-conditioning apparatus uses refrigeration cycles (a refrigerant circuit A and a heat transfer medium circuit B) through each of which a refrigerant (a heat source side refrigerant or a heat transfer medium) is circulated such that a cooling mode or a heating mode can be freely selected as its operation mode in each indoor unit. It should be noted that the dimensional relationships of components in FIG. 1 and other subsequent figures may be different from the actual ones.

Referring to FIG. 1, the air-conditioning apparatus according to Embodiment includes a single outdoor unit 1, functioning as a heat source unit, a plurality of indoor units 2, and a heat transfer medium relay unit 3 disposed between the outdoor unit 1 and the indoor units 2. The heat transfer medium relay unit 3 is configured to exchange heat between the heat source side refrigerant and the heat transfer medium. The outdoor unit 1 is connected with the heat transfer medium relay unit 3 via refrigerant pipes 4 through which the heat source side refrigerant is conveyed. The heat transfer medium relay unit 3 is connected to each indoor unit 2 via pipes (heat transfer medium pipes) 5 through which the heat transfer medium is conveyed. Cooling energy or heating energy produced in the outdoor unit 1 is delivered through the heat transfer medium relay unit 3 to the indoor units 2.

Referring to FIG. 2, the air-conditioning apparatus according to Embodiment includes a single outdoor unit 1, a plurality of indoor units 2, a plurality of separated heat transfer medium relay units 3 (a main heat transfer medium relay unit 3*a* and sub heat transfer medium relay units 3*b*) arranged between the outdoor unit 1 and the indoor units 2. The outdoor unit 1 is connected to the main heat transfer medium relay unit 3*a* through the refrigerant pipes 4. The main heat transfer medium relay unit 3*a* is connected to the sub heat transfer medium relay units 3*b* through the refrigerant pipes 4. Each of the sub heat transfer medium relay units 3*b* is connected to each indoor unit 2 through the pipes 5. Cooling energy or heating energy produced in the outdoor unit 1 is delivered through the main heat transfer medium relay unit 3*a* and the sub heat transfer medium relay units 3*b* to the indoor units 2.

The outdoor unit 1, typically disposed in an outdoor space 6 which is a space (e.g., a roof) outside a structure 9, such as a building, is configured to supply cooling energy or heating energy through the heat transfer medium relay unit 3 to the indoor units 2. Each indoor unit 2 is disposed at a position such that it can supply cooling air or heating air to an indoor space 7 which is a space (e.g., a living room) inside the structure 9 and is configured to supply the cooling air or heating air to the indoor space 7, that is, to a conditioned space. The heat transfer medium relay unit 3 is configured with a housing separate from the outdoor unit 1 and the indoor units 2 such that the heat transfer medium relay unit 3 can be disposed at a position different from those of the outdoor space 6 and the indoor space 7, and is connected to the outdoor unit 1 through the refrigerant pipes 4 and is connected to the indoor units 2 through the pipes 5 to convey cooling energy or heating energy, supplied from the outdoor unit 1, to the indoor units 2.

As illustrated in FIGS. 1 and 2, in the air-conditioning apparatus according to Embodiment, the outdoor unit 1 is connected to the heat transfer medium relay unit 3 using two refrigerant pipes 4, and the heat transfer medium relay unit 3 is connected to each indoor unit 2 using two pipes 5. As described above, in the air-conditioning apparatus according to Embodiment, each of the units (the outdoor unit 1, the indoor units 2, and the heat transfer medium relay unit 3) is connected using two pipes (the refrigerant pipes 4 or the pipes 5), thus facilitating construction.

As illustrated in FIG. 2, the heat transfer medium relay unit 3 can be separated into a single main heat transfer medium relay unit 3*a* and two sub heat transfer medium relay units 3*b* (a sub heat transfer medium relay unit 3*b*(1) and a sub heat transfer medium relay unit 3*b*(2)) derived from the main heat transfer medium relay unit 3*a*. This separation allows a plurality of sub heat transfer medium relay units 3*b* to be connected to the single main heat transfer medium relay unit 3*a*. In this configuration, the number of refrigerant pipes 4 connecting the main heat transfer medium relay unit 3*a* to each sub heat transfer medium relay unit 3*b* is three. Such a cycle will be described in detail later (refer to FIG. 4).

Furthermore, FIGS. 1 and 2 illustrate a state where each heat transfer medium relay unit 3 is disposed in a space different from the indoor space 7, for example, a space above a ceiling (hereinafter, simply referred to as a "space 8") inside the structure 9. The heat transfer medium relay unit 3 can be placed in other spaces, e.g., a common space where an elevator or the like is installed. In addition, although FIGS. 1 and 2 illustrate a case in which the indoor units 2 are of a ceiling-mounted cassette type, the indoor units are not limited to this type and, for example, a ceiling-concealed type, a ceiling-suspended type, or any type of indoor unit may be used as long as the unit can blow out heating air or cooling air into the indoor space 7 directly or through a duct or the like.

FIGS. 1 and 2 illustrate the case in which the outdoor unit 1 is disposed in the outdoor space 6. The arrangement is not limited to this case. For example, the outdoor unit 1 may be disposed in an enclosed space, for example, a machine room with a ventilation opening, may be disposed inside the structure 9 as long as waste heat can be exhausted through an exhaust duct to the outside of the structure 9, or may be disposed inside the structure 9 as long as the used outdoor unit 1 is of a water-cooled type. Even when the outdoor unit 1 is disposed in such a place, no problem in particular will occur.

Furthermore, the heat transfer medium relay unit 3 can be disposed near the outdoor unit 1. If the distance between the heat transfer medium relay unit 3 and each indoor unit 2 is too long, the conveyance power for the heat transfer medium will be considerably large. It should be therefore noted that the energy saving effect is reduced in this case. In addition, the number of outdoor units 1, the number of indoor units 2, and the number of heat transfer medium relay units 3 which are connected are not limited to the numbers illustrated in FIGS. 1 and 2. The numbers may be determined depending on the structure 9 where the air-conditioning apparatus according to Embodiment is installed.

Figure 3:
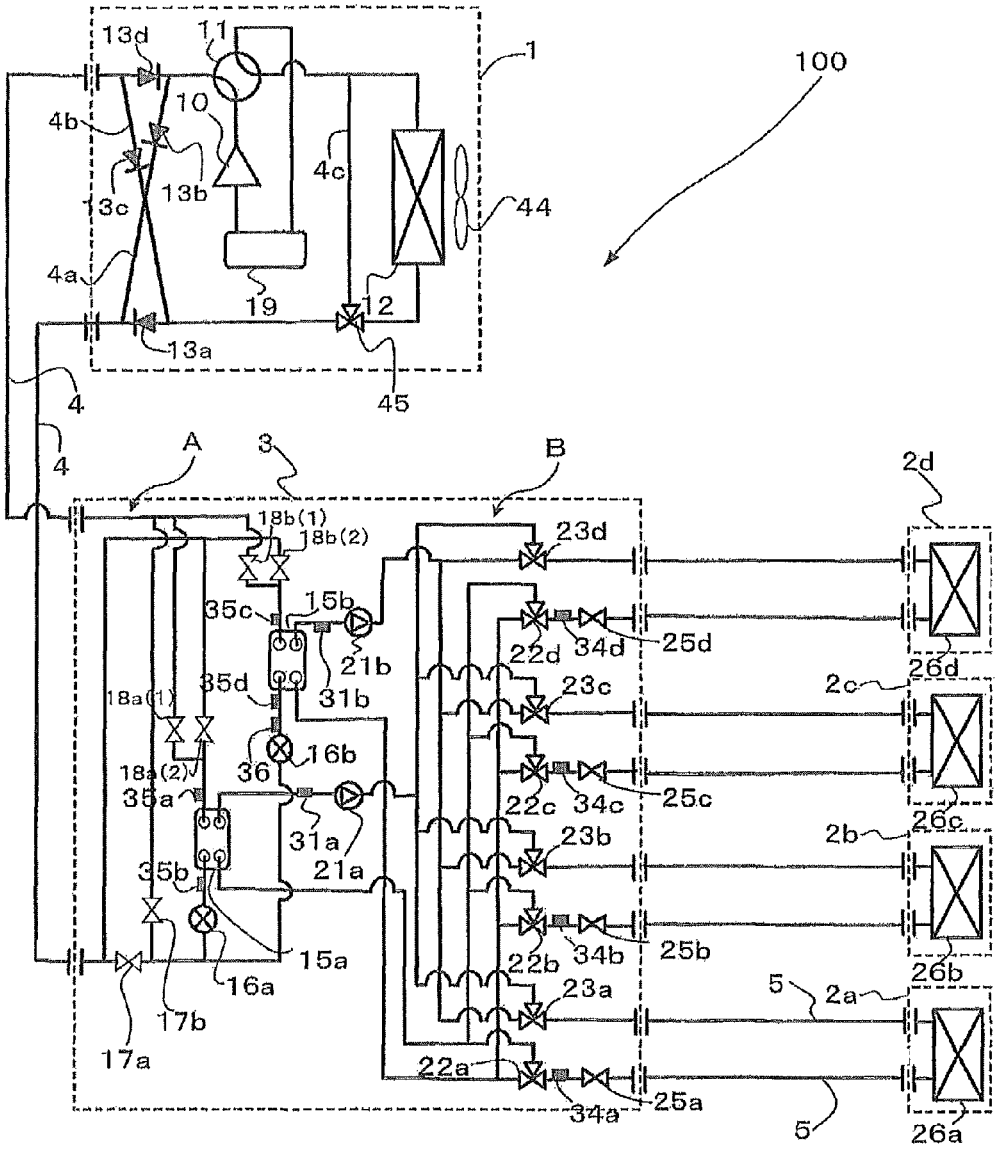
FIG. 3 is a schematic configuration diagram illustrating a configuration of the air-conditioning apparatus according to Embodiment of the invention.

FIG. 3 is a schematic configuration diagram illustrating a circuit configuration of the air-conditioning apparatus (hereinafter, referred to as an "air-conditioning apparatus 100") according to Embodiment. The detailed configuration of the air-conditioning apparatus 100 will be described with reference to FIG. 3. Referring to FIG. 3, the outdoor unit 1 is connected to the heat transfer medium relay unit 3 via the refrigerant pipes 4 through a heat exchanger related to heat transfer medium 15*a* and a heat exchanger related to heat transfer medium 15*b* which are provided for the heat transfer medium relay unit 3. Furthermore, the heat transfer medium relay unit 3 is connected to the indoor units 2 via the pipes 5 through the heat exchanger related to heat transfer medium 15*a* and the heat exchanger related to heat medium 15*b*.

[Outdoor Unit 1]

The outdoor unit 1 includes a compressor 10, a first refrigerant flow switching device 11, such as a four-way valve, a heat source side heat exchanger 12, and an accumulator 19 which are connected in series through the refrigerant pipe 4. The outdoor unit 1 further includes a first connecting pipe 4*a*, a second connecting pipe 4*b*, a check valve 13*a*, a check valve 13*b*, a check valve 13*c*, and a check valve 13*d*. Such arrangement of the first connecting pipe 4*a*, the second connecting pipe 4*b*, the check valve 13*a*, the check valve 13*b*, the check valve 13*c*, and the check valve 13*d* allows the heat source side refrigerant, allowed to flow into the heat transfer medium relay unit 3, to flow in a constant direction irrespective of the operation requested by any indoor unit 2.

In addition, the outdoor unit 1 includes a heat source side air-sending device, such as a fan, disposed near the heat source side heat exchanger 12. This heat source side air-sending device 44 is configured to supply air to the heat source side heat exchanger 12. Furthermore, as will be described in detail later, a bypass pipe 4*c* that connects a point prior to and a point after the heat source side heat exchanger 12 to bypass the heat source side heat exchanger 12 is provided for the outdoor unit 1 through a heat source side refrigerant flow control device 45. The heat source side refrigerant flow control device 45 is disposed between the heat source side heat exchanger 12 and the check valve 13*a*. The bypass pipe 4*c* is disposed so as to connect the heat source side refrigerant flow control device 45 to the refrigerant pipe 4 positioned between the first refrigerant flow switching device 11 and the heat source side heat exchanger 12.

The compressor 10 is configured to suck the heat source side refrigerant and compress the heat source side refrigerant to a high-temperature, high-pressure state, and may be, for example, a capacity-controllable inverter compressor. The first refrigerant flow switching device 11 is configured to switch flows between that of the heat source side refrigerant during a heating operation (including a heating only operation mode and a heating main operation mode) and that of the heat source side refrigerant during a cooling operation (including a cooling only operation mode and a cooling main operation mode). The heat source side heat exchanger 12 is configured to function as an evaporator in the heating operation, function as a condenser (or a radiator) in the cooling operation, exchange heat between air supplied from the heat source side air-sending device 44, such as a fan, and the heat source side refrigerant, and evaporate and gasify or condense and liquefy the heat source side refrigerant. The accumulator 19 is disposed on the suction side of the compressor 10 and is configured to store excess refrigerant.

The check valve 13*d* is provided for the refrigerant pipe 4 positioned between the heat transfer medium relay unit 3 and the first refrigerant flow switching device 11 and is configured to permit the heat source side refrigerant to flow only in a predetermined direction (the direction from the heat transfer medium relay unit 3 to the outdoor unit 1). The check valve 13*a* is provided for the refrigerant pipe 4 positioned between the heat source side heat exchanger 12 and the heat transfer medium relay unit 3 and is configured to allow the heat source side refrigerant to flow only in a predetermined direction (the direction from the outdoor unit 1 to the heat transfer medium relay unit 3). The check valve 13*b* is provided for the first connecting pipe 4*a* and is configured to allow the heat source side refrigerant discharged from the compressor 10, during the heating operation, to flow through the heat transfer medium relay unit 3. The check valve 13*c* is disposed in the second connecting pipe 4*b* and is configured to allow the heat source side refrigerant, returned from the heat transfer medium relay unit 3 during the heating operation, to flow to the suction side of the compressor 10.

The first connecting pipe 4*a* is configured to connect the refrigerant pipe 4, positioned between the first refrigerant flow switching device 11 and the check valve 13*d*, to the refrigerant pipe 4, positioned between the check valve 13*a* and the heat transfer medium relay unit 3, in the outdoor unit 1. The second connecting pipe 4*b* is configured to connect the refrigerant pipe 4, positioned between the check valve 13*d* and the heat transfer medium relay unit 3, to the refrigerant pipe 4, positioned between the heat source side heat exchanger 12 and the check valve 13*a*, in the outdoor unit 1. It should be noted that FIG. 3 illustrates a case in which the first connecting pipe 4*a*, the second connecting pipe 4*b*, the check valve 13*a*, the check valve 13*b*, the check valve 13*c*, and the check valve 13*d* are arranged but the arrangement is not limited to this case. It is not always essential to provide these components.

[Indoor Units 2]

The indoor units 2 include use side heat exchangers 26. Each of the use side heat exchangers 26 is connected to a heat transfer medium flow control device 25 and a second heat transfer medium flow switching device 23 in the heat transfer medium relay unit 3 through the pipes 5. Each of the use side heat exchangers 26 is configured to exchange heat between air supplied from an air-sending device, such as a fan, (not illustrated) and the heat transfer medium in order to produce heating air or cooling air to be supplied to the indoor space 7.

FIG. 3 illustrates a case in which four indoor units 2 are connected to the heat transfer medium relay unit 3. Illustrated are, form the bottom of the drawing, an indoor unit 2*a*, an indoor unit 2*b*, an indoor unit 2*c*, and an indoor unit 2*d*. In addition, the use side heat exchangers 26 are illustrated as, from the bottom of the drawing, a use side heat exchanger 26*a*, a use side heat exchanger 26*b*, a use side heat exchanger 26*c*, and a use side heat exchanger 26*d* each corresponding to the indoor units 2*a* to 2*d*. Note that the number of indoor units 2 connected is not limited to four as illustrated in FIG. 3, in a manner similar to the cases in FIGS. 1 and 2.

[Heat Transfer Medium Relay Unit 3]

The heat transfer medium relay unit 3 includes the two heat exchangers related to heat transfer medium 15, two expansion devices 16, two opening and closing devices 17, four second refrigerant flow switching devices 18, two pumps 21, four first heat transfer medium flow switching devices 22, the four second heat transfer medium flow switching devices 23, and the four heat transfer medium flow control devices 25. A configuration in which the heat transfer medium relay unit 3 is separated into the main heat transfer medium relay unit 3*a* and the sub heat transfer medium relay unit 3*b* will be described later with reference to FIG. 4.

Each of the two heat exchangers related to heat transfer medium 15 (the heat exchanger related to heat transfer medium 15*a* and the heat exchanger related to heat transfer medium 15*b*) is configured to function as a condenser (radiator) or an evaporator and exchange heat between the heat source side refrigerant and the heat transfer medium in order to transfer cooling energy or heating energy, produced by the outdoor unit 1 and stored in the heat source side refrigerant, to the heat transfer medium. The heat exchanger related to heat transfer medium 15*a* is disposed between an expansion device 16*a* and each of a second refrigerant flow switching device 18*a*(1) and a second refrigerant flow switching device 18*a*(2) in a refrigerant circuit A and is used to heat the heat transfer medium in the heating only operation mode and is used to cool the heat transfer medium in the cooling only operation mode, the cooling main operation mode, and the heating main operation mode.

Furthermore, the heat exchanger related to heat transfer medium 15*b* is disposed between an expansion device 16*b* and each of a second refrigerant flow switching device 18*b*(1) and a second refrigerant flow switching device 18*b*(2) in the refrigerant circuit A and is used to heat the heat transfer medium in the heating only operation mode, the cooling main operation mode, and the heating main operation mode and is used to cool the heat transfer medium in the cooling only operation mode.

The two expansion devices 16 (the expansion device 16*a* and the expansion device 16*b*) each have functions of a reducing valve and an expansion valve and are configured to reduce the pressure and expand the heat source side refrigerant. The expansion device 16*a* is disposed upstream of the heat exchanger related to heat transfer medium 15*a*, upstream regarding the heat source side refrigerant flow during the cooling operation. The expansion device 16*b* is disposed upstream of the heat exchanger related to heat transfer medium 15*b*, upstream regarding the heat source side refrigerant flow during the cooling operation. Each of the two expansion devices 16 may include a component having a variably controllable opening degree, e.g., an electronic expansion valve.

The two opening and closing devices 17 (an opening and closing device 17*a* and an opening and closing device 17*b*) each include, for example, a two-way valve and are configured to open or close the refrigerant pipe 4. The opening and closing device 17*a* is disposed in the refrigerant pipe 4 on the inlet side of the heat source side refrigerant. The opening and closing device 17*b* is disposed in a pipe connecting the refrigerant pipe 4 on the inlet side of the heat source side refrigerant and the refrigerant pipe 4 on an outlet side thereof.

The four second refrigerant flow switching devices 18 (the second refrigerant flow switching device 18*a*(1), the second refrigerant flow switching device 18*a*(2), the second refrigerant flow switching device 18*b*(1), and the second refrigerant flow switching device 18*b*(2)) each include, for example, a two-way valve and are configured to switch flow directions of the heat source side refrigerant in accordance with the operation mode. The second refrigerant flow switching device 18*a*(1) and the second refrigerant flow switching device 18*a*(2) (hereinafter, referred to as "second refrigerant flow switching devices 18A") are arranged downstream of the heat exchanger related to heat transfer medium 15*a* regarding the heat source side refrigerant flow during the cooling operation. The second refrigerant flow switching device 18*b*(1) and the second refrigerant flow switching device 18*b*(2) (hereinafter, referred to as "second refrigerant flow switching devices 18B") are arranged downstream of the heat exchanger related to heat transfer medium 15*b*, downstream regarding the heat source side refrigerant flow during the cooling only operation.

The two pumps 21 (a pump 21*a* and a pump 21*b*), serving as heat transfer medium delivery devices, are configured to circulate the heat transfer medium flowing through the pipe 5. The pump 21*a* is disposed in the pipe 5 disposed between the heat exchanger related to heat transfer medium 15*a* and the second heat transfer medium flow switching devices 23. The pump 21*b* is disposed in the pipe 5 disposed between the heat exchanger related to heat transfer medium 15*b* and the second heat transfer medium flow switching devices 23. Each of the two pumps 21 may include, for example, a capacity-controllable pump. Furthermore, the pump 21*a* may be provided for the pipe 5 disposed between the heat exchanger related to heat transfer medium 15*a* and the first heat transfer medium flow switching devices 22. Furthermore, the pump 21*b* may be provided for the pipe 5 disposed between the heat exchanger related to heat transfer medium 15*b* and the first heat transfer medium flow switching devices 22.

The four first heat transfer medium flow switching devices 22 (first heat transfer medium flow switching devices 22*a* to 22*d*) each include, for example, a three-way valve and are configured to switch passages of the heat transfer medium. The first heat transfer medium flow switching devices 22 are arranged so that the number thereof (four in this case) corresponds to the installed number of indoor units 2. Each first heat transfer medium flow switching device 22 is disposed on an outlet side of a heat transfer medium passage of the corresponding use side heat exchanger 26 such that one of the three ways is connected to the heat exchanger related to heat transfer medium 15*a*, another one of the three ways is connected to the heat exchanger related to heat transfer medium 15*b*, and the other one of the three ways is connected to the heat transfer medium flow control device 25. Furthermore, illustrated from the bottom of the drawing are the first heat transfer medium flow switching device 22*a*, the first heat transfer medium flow switching device 22*b*, the first heat transfer medium flow switching device 22*c*, and the first heat transfer medium flow switching device 22*d*, so as to correspond to the respective indoor units 2.

The four second heat transfer medium flow switching devices 23 (second heat transfer medium flow switching devices 23*a* to 23*d*) each include, for example, a three-way valve and are configured to switch passages of the heat transfer medium. The second heat transfer medium flow switching devices 23 are arranged so that the number thereof (four in this case) corresponds to the installed number of indoor units 2. Each second heat transfer medium flow switching device 23 is disposed on an inlet side of the heat transfer medium passage of the corresponding use side heat exchanger 26 such that one of the three ways is connected to the heat exchanger related to heat transfer medium 15*a*, another one of the three ways is connected to the heat exchanger related to heat transfer medium 15*b*, and the other one of the three ways is connected to the use side heat exchanger 26. Furthermore, illustrated from the bottom of the drawing are the second heat transfer medium flow switching device 23*a*, the second heat transfer medium flow switching device 23*b*, the second heat transfer medium flow switching device 23*c*, and the second heat transfer medium flow switching device 23*d* so as to correspond to the respective indoor units 2.

The four heat transfer medium flow control devices 25 (heat transfer medium flow control devices 25*a* to 25*d*) each include, for example, a two-way valve capable of controlling the area of an opening and are configured to control the flow rate of the heat transfer medium flowing through the pipe 5. The heat transfer medium flow control devices 25 are arranged so that the number thereof (four in this case) corresponds to the installed number of indoor units 2. Each heat transfer medium flow control device 25 is disposed on the outlet side of the heat transfer medium passage of the corresponding use side heat exchanger 26 such that one way is connected to the use side heat exchanger 26 and the other way is connected to the first heat transfer medium flow switching device 22. Furthermore, illustrated from the bottom of the drawing are the heat transfer medium flow control device 25*a*, the heat transfer medium flow control device 25*b*, the heat transfer medium flow control device 25*c*, and the heat transfer medium flow control device 25*d* so as to correspond to the respective indoor units 2.

Embodiment will be described with respect to the case in which each heat transfer medium flow control device 25 is disposed on the outlet side (on the downstream side) of the corresponding use side heat exchanger 26 but the arrangement is not limited to this case. Each heat transfer medium flow control device 25 may be disposed on the inlet side (on the upstream side) of the use side heat exchanger 26 such that one way is connected to the use side heat exchanger 26 and the other way is connected to the second heat transfer medium flow switching device 23.

The heat transfer medium relay unit 3 further includes various detecting means (two first temperature sensors 31, four second temperature sensors 34, four third temperature sensors 35, and a pressure sensor 36). Information (temperature information and pressure information) detected by these detecting means are transmitted to a controller (not illustrated) that performs integrated control of the operation of the air-conditioning apparatus 100 such that the information is used to control, for example, the driving frequency of the compressor 10, the rotation speed of the heat source side air-sending device 44, the rotation speed of the air-sending device (not illustrated) disposed near each use side heat exchanger 26, switching by the first refrigerant flow switching device 11, the driving frequency of the pumps 21, switching by the second refrigerant flow switching devices 18, and switching of passages of the heat transfer medium.

Each of the two first temperature sensors 31 (a first temperature sensor 31*a* and a first temperature sensor 31*b*) is configured to detect the temperature of the heat transfer medium flowing out of the heat exchanger related to heat transfer medium 15, namely, the heat transfer medium at an outlet of the heat exchanger related to heat transfer medium 15 and may include, for example, a thermistor. The first temperature sensor 31*a* is disposed in the pipe 5 connected to an inlet of the pump 21*a*. The first temperature sensor 31*b* is disposed in the pipe 5 connected to an inlet of the pump 21*b*.

Each of the four second temperature sensors 34 (second temperature sensors 34*a* to 34*d*) is disposed between the first heat transfer medium flow switching device 22 and the heat transfer medium flow control device 25 and is configured to detect the temperature of the heat transfer medium flowing out of the use side heat exchanger 26 and may include, for example, a thermistor. The second temperature sensors 34 are arranged so that the number (four in this case) corresponds to the installed number of indoor units 2. Furthermore, illustrated from the bottom of the drawing are the second temperature sensor 34*a*, the second temperature sensor 34*b*, the second temperature sensor 34*c*, and the second temperature sensor 34*d* so as to correspond to the respective indoor units 2.

Each of the four third temperature sensors 35 (third temperature sensors 35*a* to 35*d*) is disposed on the inlet side or the outlet side of a heat source side refrigerant of the heat exchanger related to heat transfer medium 15 and is configured to detect the temperature of the heat source side refrigerant flowing into the heat exchanger related to heat transfer medium 15, or the temperature of the heat source side refrigerant flowing out of the heat exchanger related to heat transfer medium 15 and may include, for example, a thermistor. The third temperature sensor 35*a* is disposed between the heat exchanger related to heat transfer medium 15*a* and the second refrigerant flow switching devices 18*a*. The third temperature sensor 35*b* is disposed between the heat exchanger related to heat transfer medium 15*a* and the expansion device 16*a*. The third temperature sensor 35*c* is disposed between the heat exchanger related to heat transfer medium 15*b* and the second refrigerant flow switching devices 18*b*. The third temperature sensor 35*d* is disposed between the heat exchanger related to heat transfer medium 15*b* and the expansion device 16*b*.

The pressure sensor 36 is disposed between the heat exchanger related to heat transfer medium 15*b* and the expansion device 16*b*, similar to the installation position of the third temperature sensor 35*d*, and is configured to detect the pressure of the heat source side refrigerant flowing between the heat exchanger related to heat transfer medium 15*b* and the expansion device 16*b*.

Furthermore, the controller (not illustrated) includes, for example, a microcomputer and controls, for example, the driving frequency of the compressor 10, the rotation speed (including ON/OFF) of the air-sending device, switching by the first refrigerant flow switching device 11, driving of the pumps 21, the opening degree of each expansion device 16, opening and closing of each opening and closing device 17, switching by the second refrigerant flow switching devices 18, switching by the first heat transfer medium flow switching devices 22, switching by the second heat transfer medium flow direction switching devices 23, and the opening degree of each heat transfer medium flow control device 25 on the basis of the information detected by the various detecting means and an instruction from a remote control to carry out the operation modes which will be described later. Note that the controller may be provided for each unit or may be provided for the outdoor unit 1 or the heat transfer medium relay unit 3.

The pipes 5 for conveying the heat transfer medium include the pipes connected to the heat exchanger related to heat transfer medium 15*a* and the pipes connected to the heat exchanger related to heat transfer medium 15*b*. Each pipe 5 is branched (into four in this case) in accordance with the number of indoor units 2 connected to the heat transfer medium relay unit 3. The pipes 5 are connected through the first heat transfer medium flow switching devices 22 and the second heat transfer medium flow switching devices 23. Controlling the first heat transfer medium flow switching devices 22 and the second heat transfer medium flow switching devices 23 determines whether the heat transfer medium flowing from the heat exchanger related to heat transfer medium 15*a* is allowed to flow into the use side heat exchanger 26 and whether the heat transfer medium flowing from the heat exchanger related to heat transfer medium 15*b* is allowed to flow into the use side heat exchanger 26.

In the air-conditioning apparatus 100, the compressor 10, the first refrigerant flow switching device 11, the heat source side heat exchanger 12, the opening and closing devices 17, the second refrigerant flow switching devices 18, a refrigerant passage of the heat exchanger related to heat transfer medium 15*a*, the expansion devices 16, and the accumulator 19 are connected through the refrigerant pipes 4, thus forming the refrigerant circuit A. In addition, a heat transfer medium passage of the heat exchanger related to heat transfer medium 15*a*, the pumps 21, the first heat transfer medium flow switching devices 22, the heat transfer medium flow control devices 25, the use side heat exchangers 26, and the second heat transfer medium flow switching devices 23 are connected through the pipes 5, thus forming heat transfer medium circuit B. In other words, the plurality of use side heat exchangers 26 are connected in parallel to each of the heat exchangers related to heat transfer medium 15, thus turning the heat transfer medium circuit B into a multi-system.

Accordingly, in the air-conditioning apparatus 100, the outdoor unit 1 and the heat transfer medium relay unit 3 are connected through the heat exchanger related to heat transfer medium 15*a* and the heat exchanger related to heat transfer medium 15*b* arranged in the heat transfer medium relay unit 3. The heat transfer medium relay unit 3 and each indoor unit 2 are connected through the heat exchanger related to heat transfer medium 15*a* and the heat exchanger related to heat transfer medium 15*b*. In other words, in the air-conditioning apparatus 100, the heat exchanger related to heat transfer medium 15*a* and the heat exchanger related to heat transfer medium 15*b* each exchange heat between the heat source side refrigerant circulating in the refrigerant circuit A and the heat transfer medium circulating in the heat transfer medium circuit B.

Figure 4:
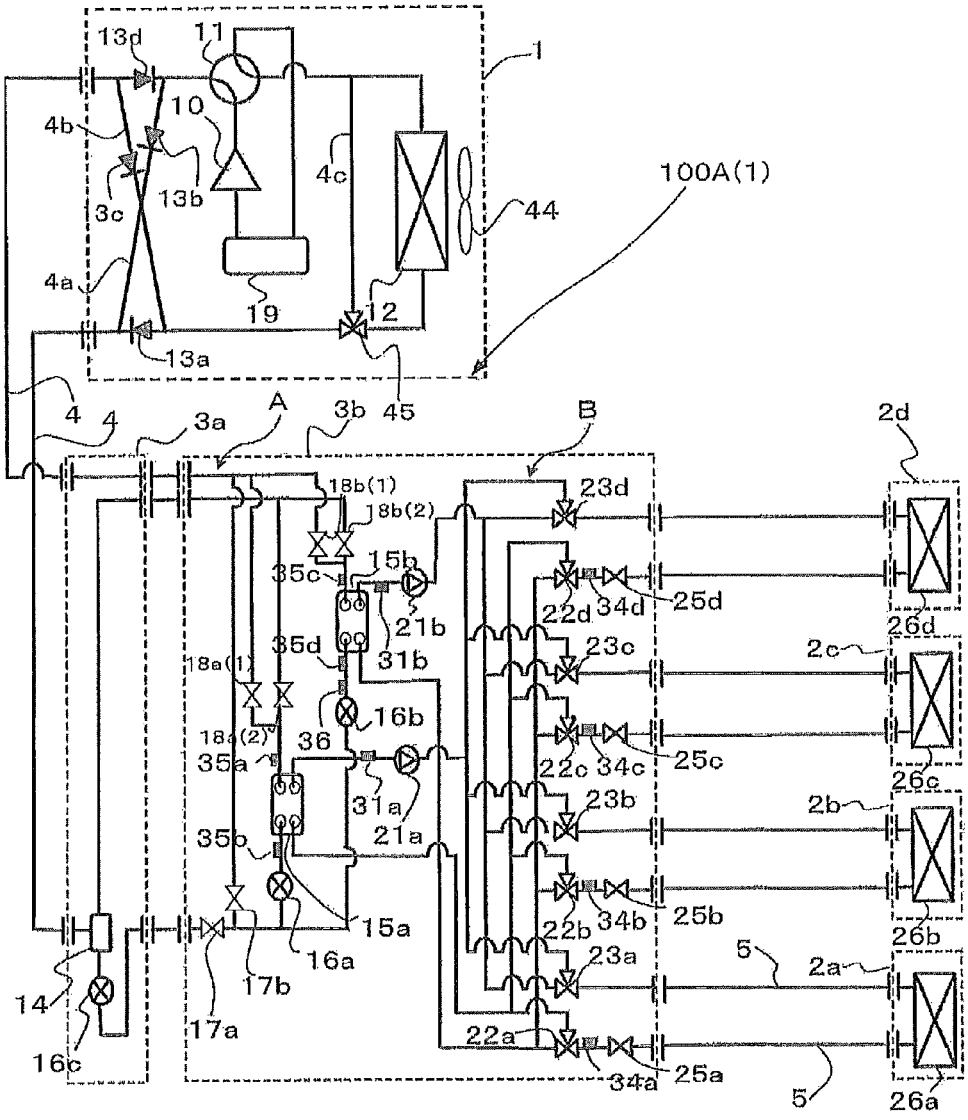
FIG. 4 is a schematic configuration diagram illustrating another configuration of an air-conditioning apparatus according to Embodiment of the invention.

FIG. 4 is a schematic configuration diagram illustrating another configuration of an air-conditioning apparatus (hereinafter, referred to as an "air-conditioning apparatus 100A(1)") according to Embodiment. The configuration of the air-conditioning apparatus 100A(1) in a case in which a heat transfer medium relay unit 3 is separated into a main heat transfer medium relay unit 3*a* and a sub heat transfer medium relay unit 3*b* will be described with reference to FIG. 4. Referring to FIG. 4, a housing of the heat transfer medium relay unit 3 is separated such that the heat transfer medium relay unit 3 is composed of the main heat transfer medium relay unit 3*a* and the sub heat transfer medium relay unit 3*b*. This separation allows a plurality of sub heat transfer medium relay units 3*b* to be connected to the single main heat transfer medium relay unit 3*a* as illustrated in FIG. 2.

The main heat transfer medium relay unit 3*a* includes a gas-liquid separator 14 and an expansion device 16*c*. Other components are arranged in the sub heat transfer medium relay unit 3*b*. The gas-liquid separator 14 is connected to a single refrigerant pipe 4 connected to an outdoor unit 1 and is connected to two refrigerant pipes 4 connected to a heat exchanger related to heat transfer medium 15*a* and a heat exchanger related to heat transfer medium 15*b* in the sub heat transfer medium relay unit 3*b*, and is configured to separate heat source side refrigerant supplied from the outdoor unit 1 into vapor refrigerant and liquid refrigerant. The expansion device 16*c*, disposed downstream regarding the flow direction of the liquid refrigerant flowing out of the gas-liquid separator 14, has functions of a reducing valve and an expansion valve and is configured to reduce the pressure and expand the heat source side refrigerant. During a cooling and heating mixed operation, the expansion device 16*c* is controlled such that the pressure in an outlet of the expansion device 16*c* is at a medium state. The expansion device 16*c* may include a component having a variably controllable opening degree, e.g., an electronic expansion valve. This arrangement allows a plurality of sub heat transfer medium relay units 3*b* to be connected to the main heat transfer medium relay unit 3*a*.

Operation modes carried out by the air-conditioning apparatus 100 will be described. The air-conditioning apparatus 100 allows each indoor unit 2, on the basis of an instruction from the indoor unit 2, to perform a cooling operation or heating operation. Specifically, the air-conditioning apparatus 100 allows all of the indoor units 2 to perform the same operation and also allows each of the indoor units 2 to perform different operations. It should be noted that since the same applies to operation modes carried out by the air-conditioning apparatus 100A(1), description of the operation modes carried out by the air-conditioning apparatus 100A(1) is omitted. In the following description, the air-conditioning apparatus includes the air-conditioning apparatus 100A(1).

The operation modes carried out by the air-conditioning apparatus 100 includes a cooling only operation mode in which all of the operating indoor units 2 perform the cooling operation, a heating only operation mode in which all of the operating indoor units 2 perform the heating operation, a cooling main operation mode which is a cooling and heating mixed operation mode in which cooling load is larger, and a heating main operation mode which is a cooling and heating mixed operation mode in which heating load is larger. The operation modes will be described below with respect to the flow of the heat source side refrigerant and that of the heat transfer medium.

[Cooling Only Operation Mode]

Figure 5:
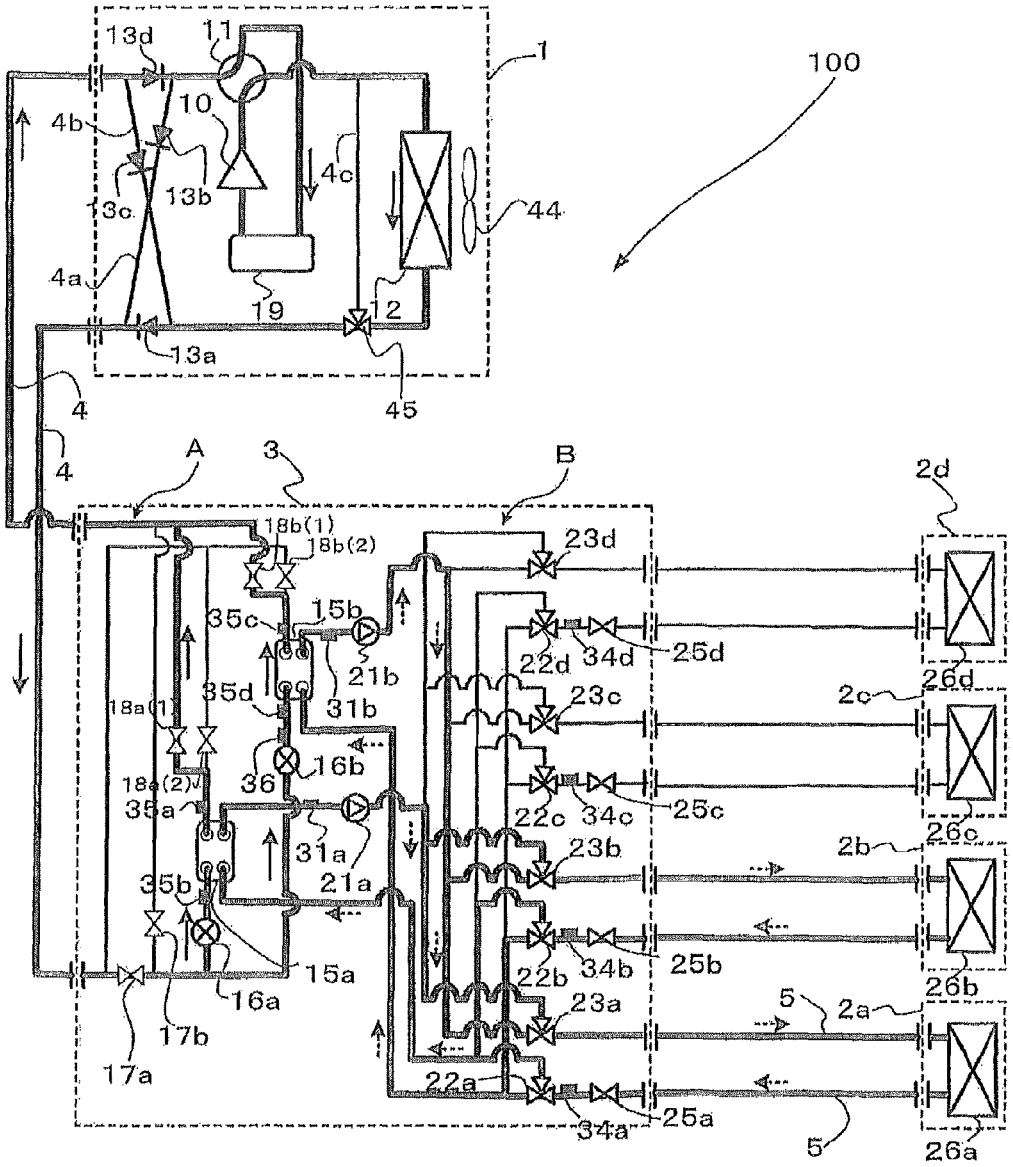
FIG. 5 is a refrigerant circuit diagram illustrating flows of refrigerants in a cooling only operation mode of the air-conditioning apparatus according to Embodiment of the invention.

FIG. 5 is a refrigerant circuit diagram illustrating the flows of refrigerants in the cooling only operation mode of the air-conditioning apparatus 100. The cooling only operation mode will be described with respect to a case in which a cooling load is generated only in a use side heat exchanger 26*a* and a use side heat exchanger 26*b* in FIG. 5. Furthermore, in FIG. 5, pipes indicated by thick lines correspond to pipes through which the refrigerants (the heat source side refrigerant and the heat transfer medium) flow. In addition, the direction of flow of the heat source side refrigerant is indicated by solid-line arrows and the direction of flow of the heat transfer medium is indicated by broken-line arrows in FIG. 5.

In the cooling only operation mode illustrated in FIG. 5, in the outdoor unit 1, a first refrigerant flow switching device 11 is switched such that the heat source side refrigerant discharged from a compressor 10 flows into a heat source side heat exchanger 12. In the heat transfer medium relay unit 3, a pump 21*a* and a pump 21*b* are driven, a heat transfer medium flow control device 25*a* and a heat transfer medium flow control device 25*b* are opened, and a heat transfer medium flow control device 25*c* and a heat transfer medium flow control device 25*d* are fully closed such that the heat transfer medium circulates between each of the heat exchanger related to heat transfer medium 15*a* and the heat exchanger related to heat transfer medium 15*b* and each of the use side heat exchanger 26*a* and the use side heat exchanger 26*b*.

First, the flow of the heat source side refrigerant in a refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. Then, the refrigerant is condensed into a high-pressure liquid refrigerant while transferring heat to outdoor air in the heat source side heat exchanger 12. The high-pressure liquid refrigerant flowing out of the heat source side heat exchanger 12 passes through a check valve 13*a*, flows out of the outdoor unit 1, passes through the refrigerant pipe 4, and flows into the heat transfer medium relay unit 3. The high-pressure liquid refrigerant flowing into the heat transfer medium relay unit 3 is branched after passing through an opening and closing device 17*a* and is expanded into a low-temperature low-pressure two-phase refrigerant by an expansion device 16*a* and an expansion device 16*b*.

This two-phase refrigerant flows into each of the heat exchanger related to heat transfer medium 15*a* and the heat exchanger related to heat transfer medium 15*b*, functioning as evaporators, removes heat from the heat transfer medium circulating in a heat transfer medium circuit B to cool the heat transfer medium, and thus turns into a low-temperature low-pressure gas refrigerant. The gas refrigerant, which has flowed out of each of the heat exchanger related to heat transfer medium 15*a* and the heat exchanger related to heat transfer medium 15*b*, flows out of the heat transfer medium relay unit 3 through the corresponding one of a second refrigerant flow switching device 18*a*(1) and a second refrigerant flow switching device 18*b*(1), passes through the refrigerant pipe 4, and again flows into the outdoor unit 1. The refrigerant flowing into the outdoor unit 1 passes through a check valve 13*d*, the first refrigerant flow switching device 11, and an accumulator 19, and is then again sucked into the compressor 10.

At this time, the opening degree of the expansion device 16*a* is controlled such that superheat (the degree of superheat) is constant, the superheat being obtained as the difference between a temperature detected by the third temperature sensor 35*a* and that detected by the third temperature sensor 35*b*. Similarly, the opening degree of the expansion device 16*b* is controlled such that superheat is constant, the superheat being obtained as the difference between a temperature detected by a third temperature sensor 35*c* and that detected by a third temperature sensor 35*d*. In addition, the opening and closing device 17*a* is opened and the opening and closing device 17*b* is closed. Furthermore, the second refrigerant flow switching device 18*a*(1) is opened, the second refrigerant flow switching device 18*a*(2) is closed, the second refrigerant flow switching device 18*b*(1) is opened, and the second refrigerant flow switching device 18*b*(2) is closed.

Next, the flow of the heat medium in the heat transfer medium circuit B will be described.

In the cooling only operation mode, both of the heat exchanger related to heat transfer medium 15*a* and the heat exchanger related to heat transfer medium 15*b* transfer cooling energy of the heat source side refrigerant to the heat transfer medium, and the pump 21*a* and the pump 21*b* allow the cooled heat transfer medium to flow through the pipes 5. The heat transfer medium, which has flowed out of each of the pump 21*a* and the pump 21*b* while being pressurized, flows through the second heat transfer medium flow switching device 23*a* and the second heat transfer medium flow switching device 23*b* into the use side heat exchanger 26*a* and the use side heat exchanger 26*b*. The heat transfer medium removes heat from the indoor air in each of the use side heat exchanger 26*a* and the use side heat exchanger 26*b*, thus cooling the indoor space 7.

Then, the heat transfer medium flows out of each of the use side heat exchanger 26*a* and the use side heat exchanger 26*b* and flows into the corresponding one of the heat transfer medium flow control device 25*a* and the heat transfer medium flow control device 25*b*. At this time, the function of each of the heat transfer medium flow control device 25*a* and the heat transfer medium flow control device 25*b* allows the heat transfer medium to flow into the corresponding one of the use side heat exchanger 26*a* and the use side heat exchanger 26*b* while controlling the heat transfer medium to a flow rate sufficient to cover an air conditioning load required in the indoor space. The heat transfer medium, which has flowed out of the heat transfer medium flow control device 25*a* and the heat transfer medium flow control device 25*b*, passes through the first heat transfer medium flow switching device 22*a* and the first heat transfer medium flow switching device 22*b*, flows into the heat exchanger related to heat transfer medium 15*a* and the heat exchanger related to heat transfer medium 15*b*, and is then again sucked into the pump 21*a* and the pump 21*b*.

Note that in the pipe 5 in each use side heat exchanger 26, the heat transfer medium is directed to flow from the second heat transfer medium flow switching device 23 through the heat transfer medium flow control device 25 to the first heat transfer medium flow switching device 22. Furthermore, the difference between a temperature detected by the first temperature sensor 31*a* or that detected by the first temperature sensor 31*b* and a temperature detected by the second temperature sensor 34 is controlled such that the difference is kept at a target value, so that the air conditioning load required in the indoor space 7 can be covered. As regards a temperature at the outlet of each heat exchanger related to heat transfer medium 15, either of the temperature detected by the first temperature sensor 31*a* and that detected by the first temperature sensor 31*b* may be used. Alternatively, the mean temperature of the two may be used. At this time, the opening degree of each of the first heat transfer medium flow switching devices 22 and the second heat transfer medium flow switching devices 23 is set to a medium degree such that passages to both of the heat exchanger related to heat transfer medium 15*a* and the heat exchanger related to heat transfer medium 15*b* are established.

Upon carrying out the cooling only operation mode, since it is unnecessary to supply the heat transfer medium to each use side heat exchanger 26 having no heat load (including thermo-off), the passage is closed by the corresponding heat transfer medium flow control device 25 such that the heat transfer medium does not flow into the use side heat exchanger 26. In FIG. 5, the heat transfer medium flows into the use side heat exchanger 26*a* and the use side heat exchanger 26*b* because these use side heat exchangers each have a heat load. The use side heat exchanger 26*c* and the use side heat exchanger 26*d* have no heat load and the corresponding heat transfer medium flow control devices 25*c* and 25*d* are fully closed. When a heat load is generated in the use side heat exchanger 26*c* or the use side heat exchanger 26*d*, the heat transfer medium flow control device 25*c* or the heat transfer medium flow control device 25*d* may be opened such that the heat transfer medium is circulated.

[Heating Only Operation Mode]

Figure 6:
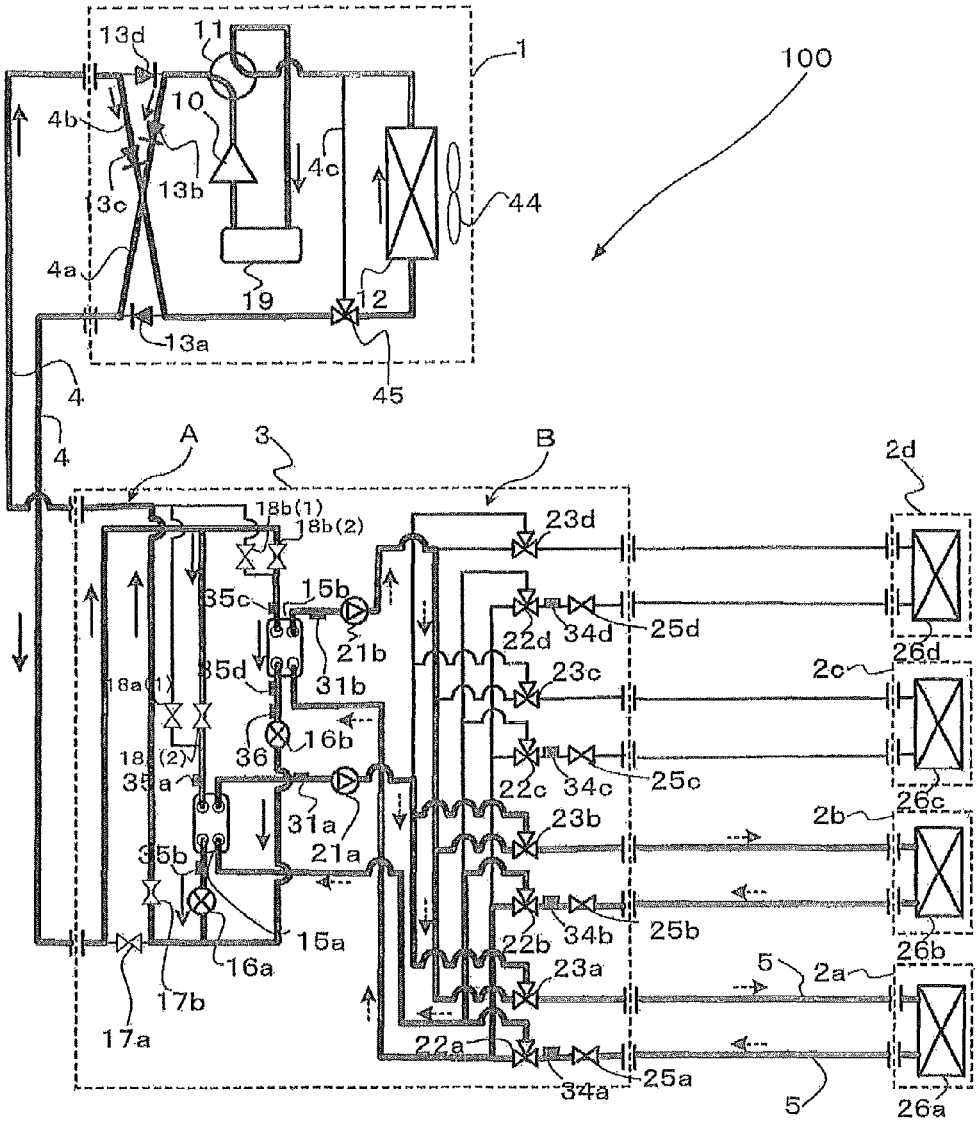
FIG. 6 is a refrigerant circuit diagram illustrating flows of the refrigerants in a heating only operation mode of the air-conditioning apparatus according to Embodiment of the invention.

FIG. 6 is a refrigerant circuit diagram illustrating the flows of the refrigerants in the heating only operation mode of the air-conditioning apparatus 100. The heating only operation mode will be described with respect to a case in which a heating load is generated only in the use side heat exchanger 26*a* and the use side heat exchanger 26*b* in FIG. 6. Furthermore, in FIG. 6, pipes indicated by thick lines correspond to pipes through which the refrigerants (the heat source side refrigerant and the heat transfer medium) flow. In addition, the direction of flow of the heat source side refrigerant is indicated by solid-line arrows and the direction of flow of the heat transfer medium is indicated by broken-line arrows in FIG. 6.

In the heating only operation mode illustrated in FIG. 6, in the outdoor unit 1, the first refrigerant flow switching device 11 is switched such that the heat source side refrigerant discharged from the compressor 10 flows into the heat transfer medium relay unit 3 without passing through the heat source side heat exchanger 12. In the heat transfer medium relay unit 3, the pump 21*a* and the pump 21*b* are driven, the heat medium flow control device 25*a* and the heat transfer medium flow control device 25*b* are opened, and the heat transfer medium flow control device 25*c* and the heat transfer medium flow control device 25*d* are fully closed such that the heat transfer medium circulates between each of the heat exchanger related to heat transfer medium 15*a* and the heat exchanger related to heat transfer medium 15*b* and each of the use side heat exchanger 26*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11, flows through the first connecting pipe 4*a*, passes through the check valve 13*b*, and flows out of the outdoor unit 1. The high-temperature high-pressure gas refrigerant, which has flowed out of the outdoor unit 1, passes through the refrigerant pipe 4 and flows into the heat transfer medium relay unit 3. The high-temperature high-pressure gas refrigerant flowing into the heat transfer medium relay unit 3 is branched. The refrigerant passes through each of the second refrigerant flow switching device 18*a*(2) and the second refrigerant flow switching device 18*b*(2) and flows into the corresponding one of the heat exchanger related to heat transfer medium 15*a* and the heat exchanger related to heat transfer medium 15*b*.

The high-temperature high-pressure gas refrigerant flowing into each of the heat exchanger related to heat transfer medium 15*a* and the heat exchanger related to heat transfer medium 15*b* is condensed into a high-pressure liquid refrigerant while transferring heat to the heat transfer medium circulating in the heat transfer medium circuit B. The liquid refrigerant flowing out of the heat exchanger related to heat transfer medium 15*a* and that flowing out of the heat exchanger related to heat transfer medium 15*b* are expanded into a low-temperature low-pressure, two-phase refrigerant through the expansion device 16*a* and the expansion device 16*b*. This two-phase refrigerant passes through the opening and closing device 17*b*, flows out of the heat transfer medium relay unit 3, passes through the refrigerant pipe 4, and again flows into the outdoor unit 1. The refrigerant flowing into the outdoor unit 1 flows through the second connecting pipe 4*b*, passes through the check valve 13*c*, and flows into the heat source side heat exchanger 12, functioning as an evaporator.

Then, the refrigerant flowing into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is again sucked into the compressor 10.

At this time, the opening degree of the expansion device 16*a* is controlled such that subcooling (the degree of subcooling) is constant, the subcooling being obtained as the difference between a value indicating a saturation temperature calculated from a pressure detected by the pressure sensor 36 and a temperature detected by the third temperature sensor 35*b*. Similarly, the opening degree of the expansion device 16*b* is controlled such that subcooling is constant, the subcooling being obtained as the difference between the value indicating the saturation temperature calculated from the pressure detected by the pressure sensor 36 and a temperature detected by the third temperature sensor 35*d*. In addition, the opening and closing device 17*a* is closed and the opening and closing device 17*b* is opened. Furthermore, the second refrigerant flow switching device 18*a*(1) is closed, the second refrigerant flow switching device 18*a*(2) is opened, the second refrigerant flow switching device 18*b*(1) is closed, and the second refrigerant flow switching device 18*b*(2) is opened. Note that in the case in which a temperature can be measured at the middle position of the heat exchangers related to heat transfer medium 15, the temperature at the middle position may be used instead of the pressure sensor 36. Thus, such a system can be constructed inexpensively.

Next, the flow of the heat transfer medium in the heat medium circuit B will be described.

In the heating only operation mode, both of the heat exchanger related to heat transfer medium 15*a* and the heat exchanger related to heat transfer medium 15*b* transfer heating energy of the heat source side refrigerant to the heat transfer medium, and the pump 21*a* and the pump 21*b* allow the heated heat transfer medium to flow through the pipes 5. The heat transfer medium, which has flowed out of the pump 21*a* and the pump 21*b* while being pressurized, flows through the second heat transfer medium flow switching device 23*a* and the second heat transfer medium flow switching device 23*b* into the use side heat exchanger 26*a* and the use side heat exchanger 26*b*. The heat transfer medium transfers heat to the indoor air through each of the use side heat exchanger 26*a* and the use side heat exchanger 26*b*, thus heating the indoor space 7.

Then, the heat transfer medium flows out of each of the use side heat exchanger 26*a* and the use side heat exchanger 26*b* and flows into the corresponding one of the heat transfer medium flow control device 25*a* and the heat transfer medium flow control device 25*b*. At this time, the function of each of the heat transfer medium flow control device 25*a* and the heat transfer medium flow control device 25*b* allows the heat transfer medium to flow into the corresponding one of the use side heat exchanger 26*a* and the use side heat exchanger 26*b* while controlling the heat transfer medium to a the flow rate sufficient to cover an air conditioning load required in the indoor space. The heat transfer medium, which has flowed out of the heat transfer medium flow control device 25*a* and the heat transfer medium flow control device 25*b*, passes through the first heat medium flow switching device 22*a* and the first heat transfer medium flow switching device 22*b*, flows into the heat exchanger related to heat transfer medium 15*a* and the heat exchanger related to heat transfer medium 15*b*, and is then again sucked into the pump 21*a* and the pump 21*b*.

Note that in the pipe 5 in each use side heat exchanger 26, the heat transfer medium is directed to flow from the second heat transfer medium flow switching device 23 through the heat transfer medium flow control device 25 to the first heat transfer medium flow switching device 22. Furthermore, the difference between a temperature detected by the first temperature sensor 31*a* or that detected by the first temperature sensor 31*b* and a temperature detected by the second temperature sensor 34 is controlled such that the difference is kept at a target value, so that the air conditioning load required in the indoor space 7 can be covered. As regards a temperature at the outlet of each heat exchanger related to heat transfer medium 15, either of the temperature detected by the first temperature sensor 31*a* and that detected by the first temperature sensor 31*b* may be used. Alternatively, the mean temperature of the two may be used.

At this time, the opening degree of each of the first heat transfer medium flow switching devices 22 and the second heat transfer medium flow switching devices 23 is set to a medium degree such that passages to both of the heat exchanger related to heat transfer medium 15*a* and the heat exchanger related to heat transfer medium 15*b* are established. Although the use side heat exchanger 26*a* should essentially be controlled on the basis of the difference between a temperature at the inlet and that at the outlet, since the temperature of the heat transfer medium on the inlet side of the use side heat exchanger 26 is substantially the same as that detected by the first temperature sensor 31*b*, the use of the first temperature sensor 31*b* can reduce the number of temperature sensors, so that the system can be constructed inexpensively.

Upon carrying out the heating only operation mode, since it is unnecessary to supply the heat transfer medium to each use side heat exchanger 26 having no heat load (including thermo-off), the passage is closed by the corresponding heat transfer medium flow control device 25 such that the heat transfer medium does not flow into the use side heat exchanger 26. In FIG. 6, the heat transfer medium is supplied to the use side heat exchanger 26*a* and the use side heat exchanger 26*b* because these use side heat exchangers each have a heat load. The use side heat exchanger 26*c* and the use side heat exchanger 26*d* have no heat load and the corresponding heat transfer medium flow control devices 25*c* and 25*d* are fully closed. When a heat load is generated in the use side heat exchanger 26*c* or the use side heat exchanger 26*d*, the heat transfer medium flow control device 25*c* or the heat transfer medium flow control device 25*d* may be opened such that the heat transfer medium is circulated.

[Cooling Main Operation Mode]

Figure 7:
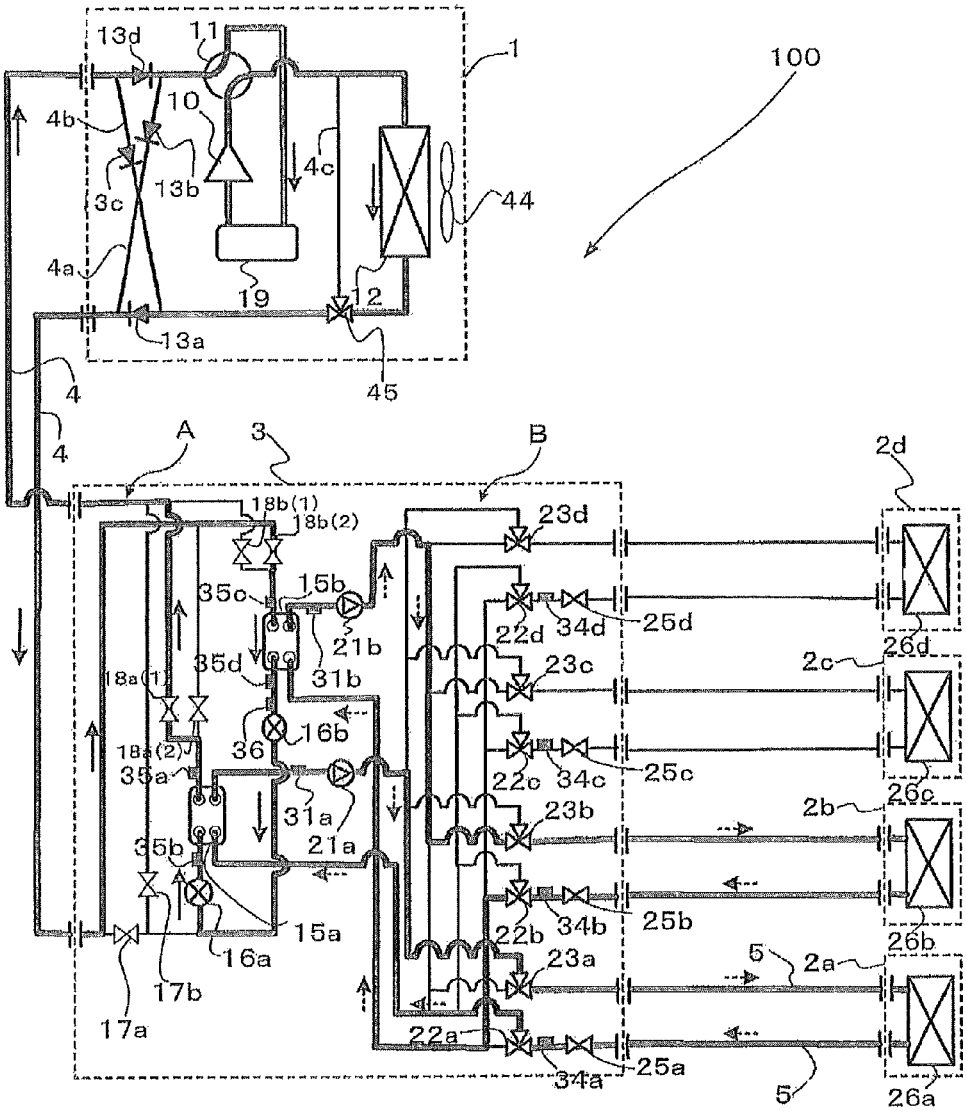
FIG. 7 is a refrigerant circuit diagram illustrating flows of the refrigerants in a cooling main operation mode of the air-conditioning apparatus according to Embodiment of the invention.

FIG. 7 is a refrigerant circuit diagram illustrating the flows of the refrigerants in the cooling main operation mode of the air-conditioning apparatus 100. The cooling main operation mode will be described with respect to a case in which a cooling load is generated in the use side heat exchanger 26*a* and a heating load is generated in the use side heat exchanger 26*b* in FIG. 7. Furthermore, in FIG. 7, pipes indicated by thick lines correspond to pipes through which the refrigerants (the heat source side refrigerant and the heat transfer medium) circulate. In addition, the direction of flow of the heat source side refrigerant is indicated by solid-line arrows and the direction of flow of the heat transfer medium is indicated by broken-line arrows in FIG. 7.

In the cooling main operation mode illustrated in FIG. 7, in the outdoor unit 1, the first refrigerant flow switching device 11 is switched such that the heat source side refrigerant discharged from the compressor 10 flows into the heat source side heat exchanger 12. In the heat transfer medium relay unit 3, the pump 21*a* and the pump 21*b* are driven, the heat transfer medium flow control device 25*a* and the heat transfer medium flow control device 25*b* are opened, and the heat transfer medium flow control device 25*c* and the heat transfer medium flow control device 25*d* are fully closed such that the heat transfer medium circulates between the heat exchanger related to heat transfer medium 15*a* and the use side heat exchanger 26*a* and the heat transfer medium circulates between the heat exchanger related to heat transfer medium 15*b* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. The refrigerant is condensed into a two-phase refrigerant in the heat source side heat exchanger 12 while transferring heat to the outside air. The two-phase refrigerant flowing out of the heat source side heat exchanger 12 passes through the check valve 13*a*, flows out of the outdoor unit 1, passes through the refrigerant pipe 4, and flows into the heat transfer medium relay unit 3. The two-phase refrigerant flowing into the heat transfer medium relay unit 3 passes through the second refrigerant flow switching device 18*b*(2) and flows into the heat exchanger related to heat transfer medium 15*b*, functioning as a condenser.

The two-phase refrigerant flowing into the heat exchanger related to heat transfer medium 15*b* is condensed into a liquid refrigerant while transferring heat to the heat transfer medium circulating in the heat transfer medium circuit B. The liquid refrigerant flowing out of the heat exchanger related to heat transfer medium 15*b* is expanded into a low-pressure two-phase refrigerant by the expansion device 16*b*. This low-pressure two-phase refrigerant flows through the expansion device 16*a* into the heat exchanger related to heat transfer medium 15*a*, functioning as an evaporator. The low-pressure two-phase refrigerant flowing into the heat exchanger related to heat transfer medium 15*a* removes heat from the heat transfer medium circulating in the heat transfer medium circuit B to cool the heat transfer medium, and thus turns into a low-pressure gas refrigerant. This gas refrigerant flows out of the heat exchanger related to heat transfer medium 15*a*, flows through the second refrigerant flow switching device 18*a*(1) out of the heat transfer medium relay unit 3, passes through the refrigerant pipe 4, and again flows into the outdoor unit 1. The refrigerant flowing into the outdoor unit 1 passes through the check valve 13*d*, the first refrigerant flow switching device 11, and the accumulator 19, and is then again sucked into the compressor 10.

At this time, the opening degree of the expansion device 16*b* is controlled such that superheat is constant, the superheat being obtained as the difference between a temperature detected by the third temperature sensor 35*a* and that detected by the third temperature sensor 35*b*. In addition, the expansion device 16*a* is fully opened, the opening and closing device 17*a* is closed, and the opening and closing device 17*b* is closed. Furthermore, the second refrigerant flow switching device 18*a*(1) is opened, the second refrigerant flow switching device 18*a*(2) is closed, the second refrigerant flow switching device 18*b*(1) is closed, and the second refrigerant flow switching device 18*b*(2) is opened. In addition, the opening degree of the expansion device 16*b* may be controlled such that subcooling is constant, the subcooling being obtained as the difference between a value indicating a saturation temperature calculated from a pressure detected by the pressure sensor 36 and a temperature detected by the third temperature sensor 35*d*. Alternatively, the expansion device 16*b* may be fully opened and the expansion device 16*a* may control superheat or subcooling.

Next, the flow of the heat transfer medium in the heat medium circuit B will be described.

In the cooling main operation mode, the heat exchanger related to heat transfer medium 15*b* transfers heating energy of the heat source side refrigerant to the heat transfer medium, and the pump 21*b* allows the heated heat transfer medium to flow through the pipes 5. Furthermore, in the cooling main operation mode, the heat exchanger related to heat transfer medium 15*a* transfers cooling energy of the heat source side refrigerant to the heat transfer medium, and the pump 21*a* allows the cooled heat transfer medium to flow through the pipes 5. The heat transfer medium, which has flowed out of each of the pump 21*a* and the pump 21*b* while being pressurized, flows through the corresponding one of the second heat transfer medium flow switching device 23*a* and the second heat transfer medium flow switching device 23*b* into the corresponding one of the use side heat exchanger 26*a* and the use side heat exchanger 26*b*.

In the use side heat exchanger 26*b*, the heat transfer medium transfers heat to the indoor air, thus heating the indoor space 7. In addition, in the use side heat exchanger 26*a*, the heat transfer medium removes heat from the indoor air, thus cooling the indoor space 7. At this time, the function of each of the heat transfer medium flow control device 25*a* and the heat transfer medium flow control device 25*b* allows the heat transfer medium to flow into the corresponding one of the use side heat exchanger 26*a* and the use side heat exchanger 26*b* while controlling the heat transfer medium to a flow rate sufficient to cover an air conditioning load required in the indoor space. The heat transfer medium, which has passed through the use side heat exchanger 26*b* with a slight decrease of temperature, passes through the heat transfer medium flow control device 25*b* and the first heat transfer medium flow switching device 22*b*, flows into the heat exchanger related to heat transfer medium 15*b*, and is then again sucked into the pump 21*b*. The heat transfer medium, which has passed through the use side heat exchanger 26*a* with a slight increase of temperature, passes through the heat transfer medium flow control device 25*a* and the first heat transfer medium flow switching device 22*a*, flows into the heat exchanger related to heat transfer medium 15*a*, and is then again sucked into the pump 21*a*.

During this time, the function of the first heat transfer medium flow switching devices 22 and the second heat transfer medium flow switching devices 23 allow the heated heat transfer medium and the cooled heat transfer medium to be introduced into the respective use side heat exchangers 26 having a heating load and a cooling load, without being mixed. Note that in the pipe 5 in each of the use side heat exchanger 26 for heating and that for cooling, the heat transfer medium is directed to flow from the second heat transfer medium flow switching device 23 through the heat transfer medium flow control device 25 to the first heat transfer medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* is controlled such that the difference is kept at a target value, so that the cooling air conditioning load required in the indoor space 7 can be covered.

Upon carrying out the cooling main operation mode, since it is unnecessary to supply the heat transfer medium to each use side heat exchanger 26 having no heat load (including thermo-off), the passage is closed by the corresponding heat transfer medium flow control device 25 such that the heat transfer medium does not flow into the use side heat exchanger 26. In FIG. 7, the heat transfer medium flows into the use side heat exchanger 26*a* and the use side heat exchanger 26*b* because these use side heat exchangers each have a heat load. The use side heat exchanger 26*c* and the use side heat exchanger 26*d* have no heat load and the corresponding heat transfer medium flow control devices 25*c* and 25*d* are fully closed. When a heat load is generated in the use side heat exchanger 26*c* or the use side heat exchanger 26*d*, the heat transfer medium flow control device 25*c* or the heat transfer medium flow control device 25*d* may be opened such that the heat transfer medium is circulated.

[Heating Main Operation Mode]

Figure 8:
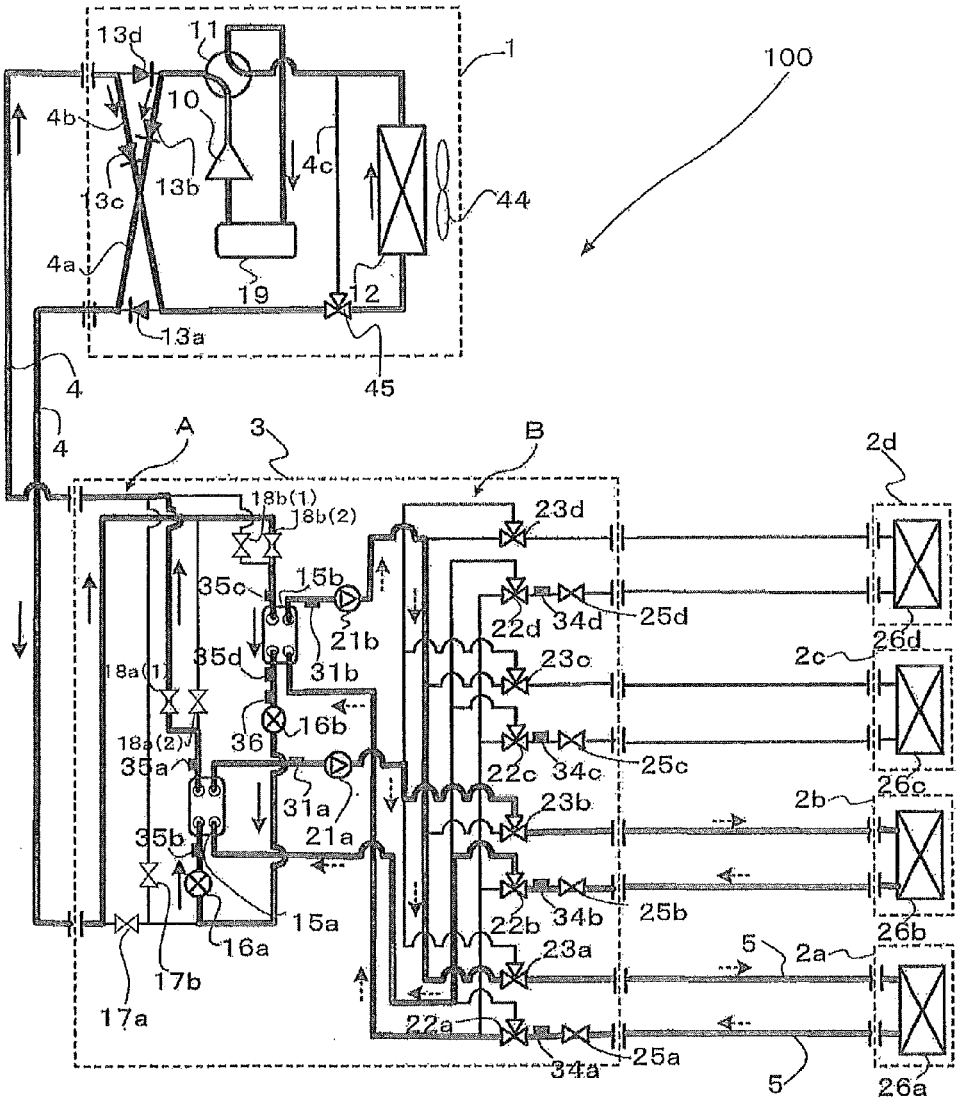
FIG. 8 is a refrigerant circuit diagram illustrating flows of the refrigerants in a heating main operation mode of the air-conditioning apparatus according to Embodiment of the invention.

FIG. 8 is a refrigerant circuit diagram illustrating the flows of the refrigerants in the heating main operation mode of the air-conditioning apparatus 100. The heating main operation mode will be described with respect to a case in which a heating load is generated in the use side heat exchanger 26*a* and a cooling load is generated in the use side heat exchanger 26*b* in FIG. 8. Furthermore, in FIG. 8, pipes indicated by thick lines correspond to pipes through which the refrigerants (the heat source side refrigerant and the heat transfer medium) circulate. In addition, the direction of flow of the heat source side refrigerant is indicated by solid-line arrows and the direction of flow of the heat transfer medium is indicated by broken-line arrows in FIG. 8.

In the heating main operation mode illustrated in FIG. 8, in the outdoor unit 1, the first refrigerant flow switching device 11 is switched such that the heat source side refrigerant discharged from the compressor 10 flows into the heat transfer medium relay unit 3 without passing through the heat source side heat exchanger 12. In the heat transfer medium relay unit 3, the pump 21*a* and the pump 21*b* are driven, the heat transfer medium flow control device 25*a* and the heat transfer medium flow control device 25*b* are opened, and the heat transfer medium flow control device 25*c* and the heat transfer medium flow control device 25*d* are closed such that the heat transfer medium circulates between the heat exchanger related to heat transfer medium 15*a* and the use side heat exchanger 26*b* and the heat transfer medium circulates between the heat exchanger related to heat transfer medium 15*b* and the use side heat exchanger 26*a*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11, flows through the first connecting pipe 4*a*, passes through the check valve 13*b*, and flows out of the outdoor unit 1. The high-temperature high-pressure gas refrigerant, which has flowed out of the outdoor unit 1, passes through the refrigerant pipe 4 and flows into the heat transfer medium relay unit 3. The high-temperature high-pressure gas refrigerant flowing into the heat transfer medium relay unit 3 passes through the second refrigerant flow switching device 18*b*(2) and flows into the heat exchanger related to heat transfer medium 15*b*, functioning as a condenser.

The gas refrigerant flowing into the heat exchanger related to heat transfer medium 15*b* is condensed into a liquid refrigerant while transferring heat to the heat transfer medium circulating in the heat transfer medium circuit B. The liquid refrigerant flowing out of the heat exchanger related to heat transfer medium 15*b* is expanded into a low-pressure two-phase refrigerant by the expansion device 16*b*. This low-pressure two-phase refrigerant flows through the expansion device 16*a* into the heat exchanger related to heat transfer medium 15*a*, functioning as an evaporator. The low-pressure two-phase refrigerant flowing into the heat exchanger related to heat transfer medium 15*a* removes heat from the heat transfer medium circulating in the heat transfer medium circuit B to evaporate, thus cooling the heat transfer medium. This low-pressure two-phase refrigerant flows out of the heat exchanger related to heat transfer medium 15*a*, passes through the second refrigerant flow switching device 18*a*(1), flows out of the heat transfer medium relay unit 3, passes through the refrigerant pipe 4, and again flows into the outdoor unit 1.

The refrigerant flowing into the outdoor unit 1 passes through the check valve 13*c* and flows into the heat source side heat exchanger 12, functioning as an evaporator. Then, the refrigerant flowing into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is again sucked into the compressor 10.

At this time, the opening degree of the expansion device 16*b* is controlled such that subcooling is constant, the subcooling being obtained as the difference between a value indicating a saturation temperature calculated from a pressure detected by the pressure sensor 36 and a temperature detected by the third temperature sensor 35*b*. In addition, the expansion device 16*a* is fully opened, the opening and closing device 17*a* is closed, and the opening and closing device 17*b* is closed. Furthermore, the second refrigerant flow switching device 18*a*(1) is opened, the second refrigerant flow switching device 18*a*(2) is closed, the second refrigerant flow switching device 18*b*(1) is closed, and the second refrigerant flow switching device 18*b*(2) is opened. Alternatively, the expansion device 16*b* may be fully opened and the expansion device 16*a* may control subcooling.

Next, the flow of the heat transfer medium in the heat medium circuit B will be described.

In the heating main operation mode, the heat exchanger related to heat transfer medium 15*b* transfers heating energy of the heat source side refrigerant to the heat transfer medium, and the pump 21*b* allows the heated heat transfer medium to flow through the pipes 5. Furthermore, in the heating main operation mode, the heat exchanger related to heat transfer medium 15*a* transfers cooling energy of the heat source side refrigerant to the heat transfer medium, and the pump 21*a* allows the cooled heat transfer medium to flow through the pipes 5. The heat transfer medium, which has flowed out of each of the pump 21*a* and the pump 21*b* while being pressurized, flows through the corresponding one of the second heat transfer medium flow switching device 23*a* and the second heat transfer medium flow switching device 23*b* into the corresponding one of the use side heat exchanger 26*a* and the use side heat exchanger 26*b*.

In the use side heat exchanger 26*b*, the heat transfer medium removes heat from the indoor air, thus cooling the indoor space 7. In addition, in the use side heat exchanger 26*a*, the heat transfer medium transfers heat to the indoor air, thus heating the indoor space 7. At this time, the function of each of the heat transfer medium flow control device 25*a* and the heat transfer medium flow control device 25*b* allows the heat transfer medium to flow into the corresponding one of the use side heat exchanger 26*a* and the use side heat exchanger 26*b* while controlling the heat transfer medium to a flow rate sufficient to cover an air conditioning load required in the indoor space. The heat transfer medium, which has passed through the use side heat exchanger 26*b* with a slight increase of temperature, passes through the heat transfer medium flow control device 25*b* and the first heat transfer medium flow switching device 22*b*, flows into the heat exchanger related to heat transfer medium 15*a*, and is then again sucked into the pump 21*a*. The heat transfer medium, which has passed through the use side heat exchanger 26*a* with a slight decrease of temperature, passes through the heat transfer medium flow control device 25*a* and the first heat transfer medium flow switching device 22*a*, flows into the heat exchanger related to heat transfer medium 15*b*, and is then again sucked into the pump 21*b*.

During this time, the first heat transfer medium flow switching devices 22 and the second heat transfer medium flow direction switching devices 23 allow the heated heat transfer medium and the cooled heat transfer medium to be introduced into the respective use side heat exchangers 26 having a heating load and a cooling load, without being mixed. Note that in the pipe 5 in each of the use side heat exchanger 26 for heating and that for cooling, the heat transfer medium is directed to flow from the second heat transfer medium flow switching device 23 through the heat transfer medium flow control device 25 to the first heat transfer medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* such that the difference is kept at a target value, so that the cooling air conditioning load required in the indoor space 7 can be covered.

Upon carrying out the heating main operation mode, since it is unnecessary to supply the heat transfer medium to each use side heat exchanger 26 having no heat load (including thermo-off), the passage is closed by the corresponding heat transfer medium flow control device 25 such that the heat transfer medium does not flow into the use side heat exchanger 26. In FIG. 7, the heat transfer medium flows into the use side heat exchanger 26*a* and the use side heat exchanger 26*b* because these use side heat exchangers each have a heat load. The use side heat exchanger 26*c* and the use side heat exchanger 26*d* have no heat load and the corresponding heat transfer medium flow control devices 25*c* and 25*d* are fully closed. When a heat load is generated in the use side heat exchanger 26*c* or the use side heat exchanger 26*d*, the heat transfer medium flow control device 25*c* or the heat transfer medium flow control device 25*d* may be opened such that the heat transfer medium is circulated.

[Refrigerant Pipes 4]

As described above, the air-conditioning apparatus 100 according to Embodiment has the several operation modes. In these operation modes, the heat source side refrigerant flows through the refrigerant pipes 4 connecting the outdoor unit 1 and the heat transfer medium relay unit 3.

[Pipes 5]

In some operation modes carried out by the air-conditioning apparatus 100 according to Embodiment, the heat transfer medium, such as water or antifreeze, flows through the pipes 5 connecting the heat transfer medium relay unit 3 and the indoor units 2.

[Capacity Control of Heat Source Side Heat Exchanger 12]

While the air-conditioning apparatus 100 according to Embodiment operates as described above, the apparatus is required to properly control a refrigeration cycle in accordance with a temperature and humidity of outdoor air, that is, the ambient environment, of the heat source side heat exchanger 12 in each operation mode, and is required to exhibit a heating capacity or cooling capacity based on a heat load or the like in the indoor space 7 which is a conditioned space. In order to control the refrigeration cycle in accordance with the ambient environment of the heat source side heat exchanger 12, the amount of heat exchanged (heat amount) in the heat source side heat exchanger 12 needs to be controlled. A heat amount Q [kW] in a heat exchanger is schematically expressed by the following Equation (1).

$$Q\ [\mathrm{kW}]=A\ [\mathrm{m}^2]\times K\ [\mathrm{kW/m^2K}]\times(Tr-Ta)[\text{degree C.}] \qquad \text{Equation (1)}$$

In Equation (1), A denotes the heat transfer area [$m^2$] of the heat exchanger, K denotes the overall heat transfer coefficient [$kW/m^2K$] between a refrigerant (heat transfer medium) in the heat exchanger and a fluid surrounding it, Ta denotes the temperature [degree C.] of the fluid surrounding the heat exchanger, and Tr denotes the temperature [degree C.] of the refrigerant (heat transfer medium) in the heat exchanger. Note that Equation (1) is an expression specific to a case in which the heat exchanger operates as a condenser, and in the case in which the heat exchanger operates as an evaporator, the temperature of the air and that of the refrigerant change places in Equation (1). When this equation is simplified, the following Equation (2) is obtained.

$$Q\ [\mathrm{kW}]=AK\ [\mathrm{kW/K}]\times(Tr-Ta)[\text{degree C.}] \qquad \text{Equation (2)}$$

In Equation (2), AK denotes the product of the heat transfer area and the overall heat transfer coefficient of the heat exchanger and indicates a value [kW/K] that expresses the capacity of the overall heat transfer coefficient per unit temperature. This Equation (2) indicates that as long as the difference between the temperature Tr of the refrigerant in the heat exchanger and the temperature Ta of the fluid surrounding the heat exchanger is constant, controlling of AK can control the heat amount Q in the heat exchanger.

Now, let us consider the heat source side heat exchanger 12. The capacity to be exhibited by the heat source side heat exchanger 12 depends on, for example, the temperature and humidity of the outdoor air, the heat amount required on the load side, and the frequency of the compressor 10. For example, in the cooling operation, the frequency of the compressor 10 is changed to control the evaporating temperature (low pressure) at a constant value, and while the heat source side heat exchanger 12 is operating as a condenser (gas cooler), an attempt is made to control the condensing temperature (high pressure) at a constant value by control of the heat amount in the heat source side heat exchanger 12. When there is a change in the ambient environment of the condenser or a cooling load in the evaporator, because the same refrigerant circulates through the refrigeration cycle, the heat amount in the heat source side heat exchanger 12 also has to be controlled in order to set the condensing temperature (high pressure) in the refrigerant circuit to a target value.

It is therefore necessary to control the heat amount in the heat source side heat exchanger 12 in accordance with a change of the ambient environment or a change of an operation state. As described above, Equation (2) indicates that AK of the heat source side heat exchanger 12 may be controlled in order to control the heat amount in the heat source side heat exchanger 12.

As illustrated in FIGS. 3 to 8, the outdoor unit 1 includes the heat source side air-sending device 44 for sending air to the heat source side heat exchanger 12. In addition, the bypass pipe 4*c* bypassing the heat source side heat exchanger 12 is disposed between a passage connected to an inlet side of the heat source side heat exchanger 12 and a passage connected to an outlet side thereof. Furthermore, the heat source side refrigerant flow control device 45 capable of controlling the ratio (proportion) of the flow rate of the refrigerant flowing through the heat source side heat exchanger 12 to that of the refrigerant flowing through the bypass pipe 4*c* is disposed at the junction of the passage connected to the inlet side of the heat source side heat exchanger 12 and an inlet passage of the bypass pipe 4*c*. In other words, the amount of heat exchanged in the heat source side heat exchanger 12 is controlled by the heat source side air-sending device 44 and the heat source side refrigerant flow control device 45.

The heat source side air-sending device 44 includes blades that rotate to create a current of air, a motor for rotating the blades, and an inverter for controlling the rotation speed of the motor. Controlling the rotation speed of the heat source side air-sending device 44 changes the amount of air current passing through the heat source side heat exchanger 12, and thus AK of the heat source side heat exchanger 12 can be changed.

Furthermore, the heat source side refrigerant flow control device 45 includes a component configured such that the areas of openings of two passages are changed using, for example, electronic stepper motors. Controlling this heat source side refrigerant flow control device 45 can control the ratio of the flow rate of the refrigerant flowing through the heat source side heat exchanger 12 and that of the refrigerant flowing through the bypass pipe 4*c*. Controlling the flow rate of the refrigerant flowing through the heat source side heat exchanger 12 can control the amount of energy stored by the refrigerant, and thus the amount of heat transferred to the ambient air through the heat source side heat exchanger 12 can be controlled.

The exchanged heat amount Qr in the heat exchanger is expressed by the following Equation (3).

$$Qr=Gr\times(hri-hro) \quad \text{Equation (3)}$$

In Equation (3), Gr denotes the mass flow rate [kg/h] of the refrigerant, hri denotes the enthalpy [kJ/kg] of the refrigerant at an inlet of the heat exchanger, and hro denotes the enthalpy [kJ/kg] of the refrigerant at an outlet of the heat exchanger.

In other words, assuming that the enthalpy hri and the enthalpy hro of the refrigerant are constant, when the mass flow rate Gr of the refrigerant is changed, the heat amount Qr in the heat exchanger can be changed. The change of the heat amount in the heat exchanger means a change of AK of the heat exchanger on the basis of the above-described Equation (2). Accordingly, controlling the heat source side refrigerant flow control device 45 controls the flow rate of the refrigerant flowing into the heat source side heat exchanger 12, and thus AK of the heat source side heat exchanger 12 can be controlled.

The heat source side air-sending device 44 rotates against the air resistance of the ambient air. To stably rotate the heat source side air-sending device 44, therefore, it has to be rotated at a minimum rotation speed, which is determined by the structure of the air-sending device, or higher. If the rotation speed is at or below the minimum rotation speed, the air-sending device stops. In the air-conditioning apparatus 100, therefore, control of the amount of air with the heat source side air-sending device 44 and control of the flow rates of the refrigerant with the heat source side refrigerant flow control device 45 are jointly performed to appropriately control AK.

Figure 9:
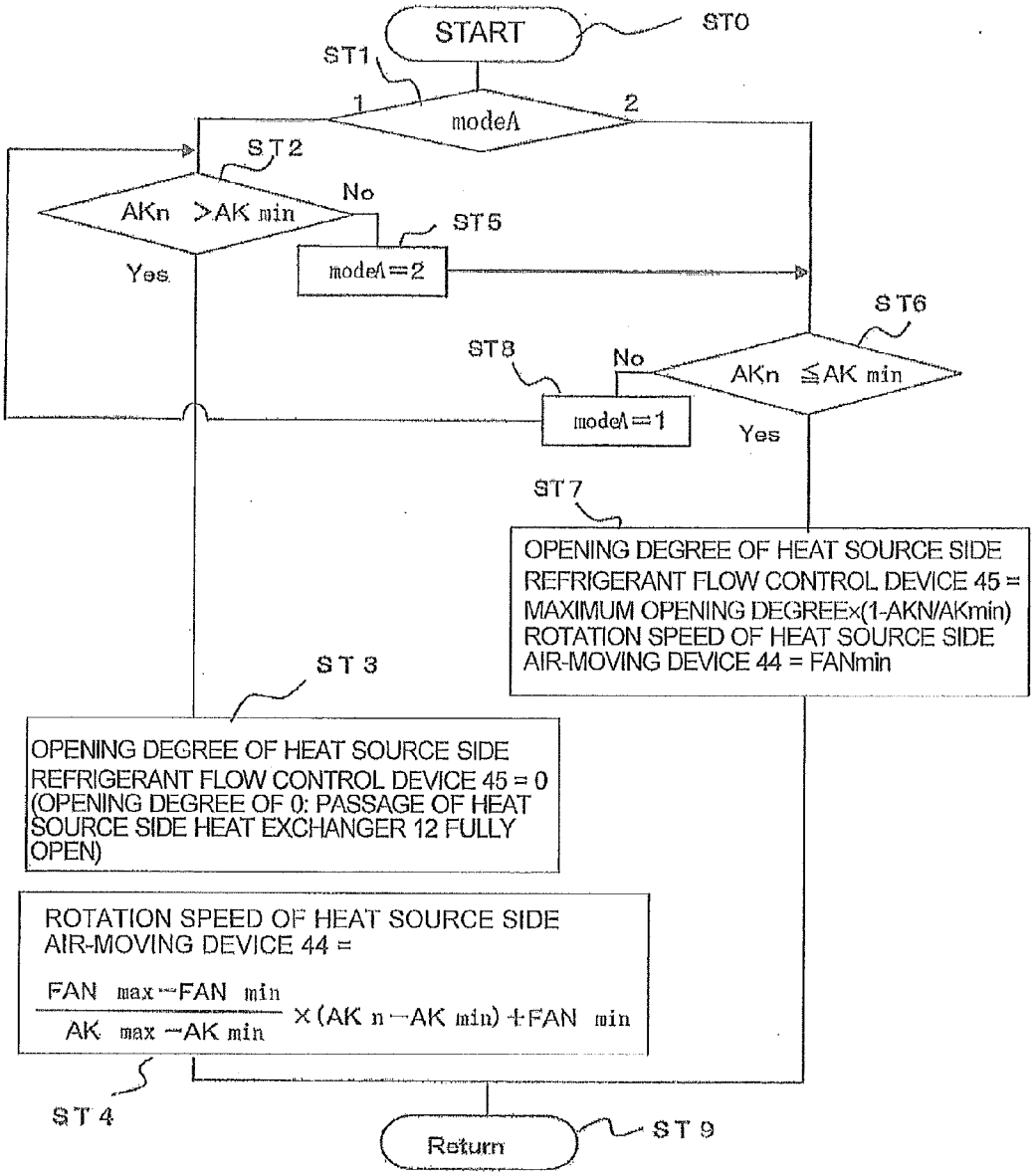
FIG. 9 is a flowchart illustrating a flow of a joint control process by a heat source side air-sending device and a heat source side refrigerant flow control device in the air-conditioning apparatus according to Embodiment of the invention.

FIG. 9 is a flowchart illustrating a flow of a joint control process between the heat source side air-sending device 44 and the heat source side refrigerant flow control device 45. An exemplary method of the joint control between the heat source side air-sending device 44 and the heat source side refrigerant flow control device 45 will be described with reference to FIG. 9. Since AK in the heat source side heat exchanger 12 varies depending on, for example, the type of heat exchanger, AK is expressed as a ratio of the maximum AK which the heat exchanger can exhibit. In the following description, this ratio will be called AK [%]. In other words, AK has a value ranging from 0 to 100. Furthermore, AKn denotes a target value of AK.

When an operation of the air-conditioning apparatus 100 is started, the controller (not illustrated) starts the joint control process (ST0). First, the controller determines an AK control mode (hereinafter, referred to as a "mode A") (ST1). If mode A is 1 (ST1=1), the controller determines whether AKn is greater than a minimum capacity value AKmin of the heat source side heat exchanger 12 which can be controlled by the heat source side air-sending device 44 (ST2).

When determining that AKn is greater than AKmin (ST2=Yes), the controller sets the opening degree of the heat source side refrigerant flow control device 45 such that the passage to the heat source side heat exchanger 12 is fully opened and the passage to the bypass pipe 4*c* is fully closed (ST3). Then, the controller controls the heat source side air-sending device 44 and controls the capacity of the heat source side heat exchanger 12 on the basis of the following Equation (4) (ST4) and completes the process (ST9). Specifically, when determining that the necessary amount of heat exchanged in the heat source side heat exchanger 12 is sufficiently large, the controller performs the control of the rotation speed of the heat source side air-sending device 44 preferentially over the heat source side refrigerant flow rate control by the heat source side refrigerant flow control device 45.

Equation (4)

$$\text{Rotation speed of heat source side air-moving 44} = \frac{\text{FAN}_{max}-\text{FAN}_{min}}{AK_{max}-AK_{min}}\times(AK_n-AK_{min})+\text{FAN}_{min} \quad \text{[Math. 1]}$$

In Equation (4), AKmax denotes a maximum capacity value (=100) [%] of the heat source side heat exchanger 12, AKmax and AKmin denote the maximum and minimum capacity values [%] of the heat source side heat exchanger 12 which can be controlled by the heat source side air-sending device 44, FANmax denotes a maximum rotation speed [%] of the heat source side air-sending device 44, and FANmin denotes a minimum rotation speed [%] of the heat source side heat exchanger 12.

Whereas, when determining that mode A is 2 (ST1=2), the controller determines whether AKn is smaller than AKmin. When determining that AKn is smaller than or equal to AKmin (ST6=Yes), the controller controls the opening degree (opening areas) of the heat source side refrigerant flow control device 45 as expressed by the following Equation (5) to control the capacity of the heat source side heat exchanger 12 (ST7), and completes the process (ST9). In other words, when determining that the necessary amount of heat exchanged in the heat source side heat exchanger 12 has dropped to some extent, the controller performs the heat source side refrigerant flow rate control by the heat source side refrigerant flow control device 45 preferentially over the control of the rotation speed of the heat source side air-sending device 44.

$$\text{Opening degree of heat source side refrigerant flow control device 45} = \text{maximum opening degree}\times(1-Akn/Ak\text{min}) \quad \text{Equation (5)}$$

Furthermore, if it is determined in ST2 that AKn is smaller than or equal to AKmin, the controller sets mode A to 2 (ST5) and shifts to the determination step in ST6. In addition, if it is determined in ST6 that AKn is greater than AKmin, the controller sets mode A to 1 (ST8) and shifts to the determination step in ST2.

In FIG. 9, mode A=1 indicates a heat exchange mode in which the entirety of the amount of the heat source side refrigerant is allowed to flow into the heat source side heat exchanger 12 to heat exchange and substantially none of the heat source side refrigerant is allowed to pass through the bypass pipe 14. Furthermore, mode A=2 indicates a heat exchange mode in which heat is exchanged while the entirety of the amount of the heat source side refrigerant is not allowed to flow into the heat source side heat exchanger 12, and the ratio of the flow rate of the refrigerant flowing through the heat source side heat exchanger 12 and that of the refrigerant flowing through the bypass pipe 14 is controlled.

In this case, the heat source side refrigerant flow control device 45 is provided such that when the opening degree is zero, the passage to the heat source side heat exchanger 12 is fully opened and the passage to the bypass pipe 4*c* is fully closed, and when the opening degree is maximum, the passage to the heat source side heat exchanger 12 is fully closed and the passage to the bypass pipe 4*c* is fully opened. Furthermore, as regards the values of AKmax and AKmin, for example, AKmax is 100 and AKmin is 25.

With the above-described control, the air-conditioning apparatus 100 changes the rotation speed of the heat source side air-sending device 44 when AK is large to control the amount of heat exchanged in the heat source side heat exchanger 12, and changes the opening degree (opening areas) of the heat source side refrigerant flow control device 45 when AK is small to control the amount of heat exchanged in the heat source side heat exchanger 12, such that AK can be changed in the range of about 0 to about 100.

Furthermore, while the case in which the heat source side refrigerant flow control device 45 is a three-way valve (three-way flow control device) capable of controlling the flow rate ratio of three passages has been described as an example, for example, a two-way valve (two-way flow control device) capable of controlling the opening area may be disposed in each of the passage of the heat source side heat exchanger 12 and that of the bypass pipe 4*c* and the valves may be controlled separately. In this case, both of the heat source side refrigerant flow control devices 45 may be controlled such that the sum of the opening areas of the devices are not much changed.

In addition, while the case in which the heat source side heat exchanger 12 operates as a condenser has been described as an example, the same applies to a case in which the heat source side heat exchanger 12 operates as an evaporator and the same advantages are obtained. Furthermore, in the case in which the heat source side refrigerant is a refrigerant, such as $CO_2$, which changes to a supercritical state on the high-pressure side, the same holds true.

The air-conditioning apparatus 100 can control the heat amount in the heat source side heat exchanger 12 in each operation mode in the above-described manner. Incidentally, as regards the method of controlling AK in the heat source side heat exchanger 12, a method of dividing the heat source side heat exchanger 12 into several heat exchangers (for example, four heat exchangers) and changing the capacity (heat transfer area) of the heat exchanger in accordance with a value of AK may be used.

If the mass flow rate of the refrigerant in the heat source side heat exchanger 12 and the air velocity of the heat source side air-sending device 44 are constant, the thermal conductivity inside a pipe of the refrigerant and that outside the pipe thereof in the heat source side heat exchanger 12 are not changed. Accordingly, a variation in stored energy (a variation in enthalpy) of the refrigerant when the refrigerant moves by a unit length in the heat source side heat exchanger 12 is the same. If the heat transfer area (A) is changed in order to change AK, therefore, a variation in enthalpy at the inlet and outlet of the heat source side heat exchanger 12 decreases substantially proportional to AK. Accordingly, by reducing the frequency of the compressor 10 to change a variation in stored energy (a variation in enthalpy) of the heat source side refrigerant when the heat source side refrigerant moves by a unit length in the heat source side heat exchanger 12, AK control can be carried out while controlling the quantity of state of the refrigerant at the outlet of the heat source side heat exchanger 12, namely, subcooling thereof, to be constant.

According to the method using the heat source side refrigerant flow control device 45, however, since the heat transfer area of the heat source side heat exchanger 12 does not change, the mass flow rate of the heat source side refrigerant inside the pipe of the heat source side heat exchanger 12 is reduced in order to control AK. At this time, if the air velocity of the heat source side air-sending device 44 is constant, the thermal conductivity outside the pipe of the heat source side heat exchanger 12 does not change. Accordingly, a variation in enthalpy of the refrigerant when the refrigerant moves by a unit length in the heat source side heat exchanger 12 does not change so much. Therefore, subcooling of the refrigerant at the outlet of the heat source side heat exchanger 12 increases, and a state of the heat source side refrigerant after merging with the heat source side refrigerant that has passed through the bypass pipe 4*c* is the same as that of the refrigerant at the outlet of the heat source side heat exchanger 12 that has been divided into several heat source side heat exchangers 12 and that has changed the heat transfer area.

Furthermore, as the temperature of the heat source side refrigerant falls, its density increases, resulting in more heat source side refrigerant in the heat source side heat exchanger 12. If there is much excess refrigerant in the refrigerant circuit, AK control can be performed using the above-described method. However, the actual amount of excess refrigerant is determined by the capacity of the accumulator 19. Accordingly, if the length of an extension pipe is long, the amount of refrigerant is expected to be insufficient for performing AK control in all the operation modes using the above-described control method.

Figure 10:
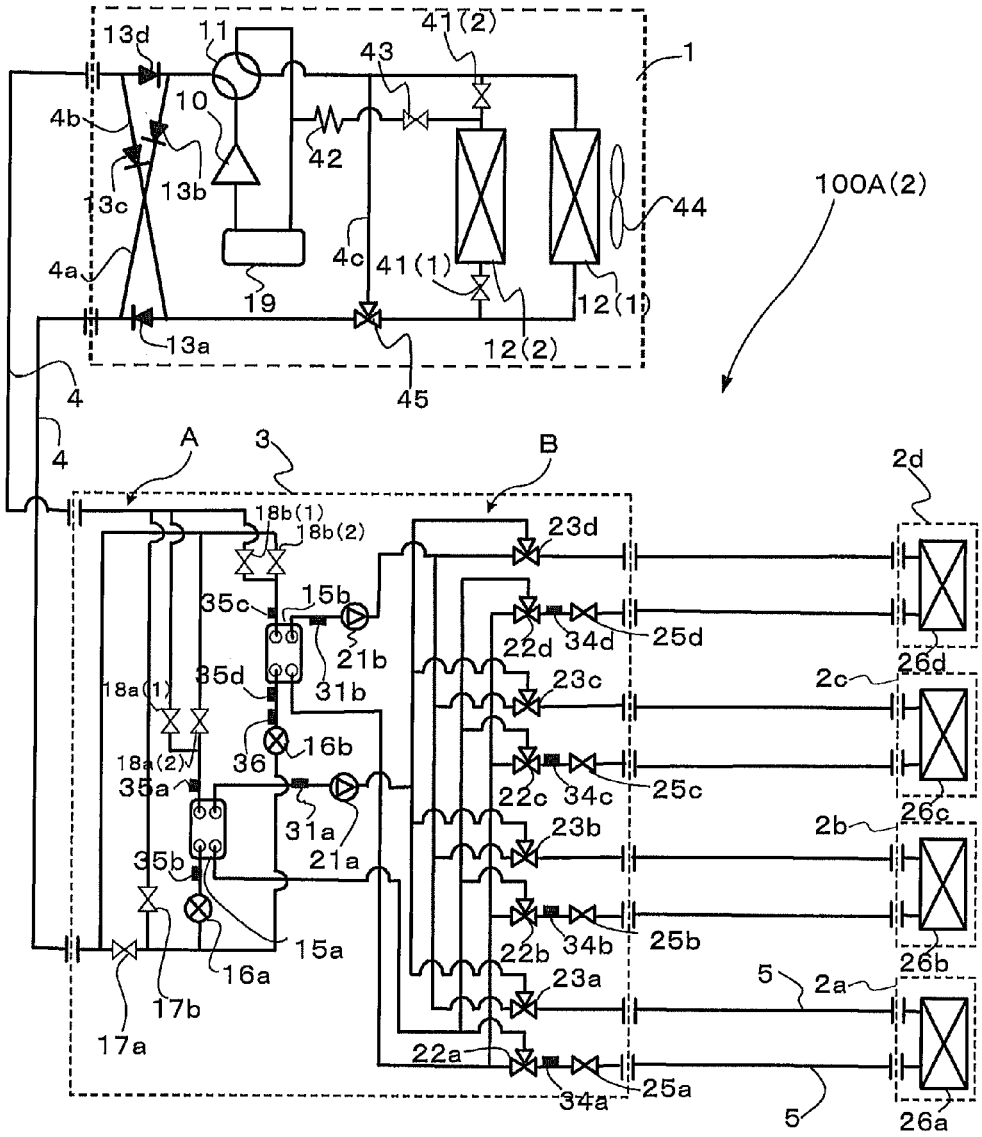
FIG. 10 is a schematic configuration diagram illustrating another configuration of an air-conditioning apparatus according to Embodiment of the invention.

Now, considered is a method of covering the insufficient amount of refrigerant and achieving stable control by dividing a heat source side heat exchanger 12 into two and recovering refrigerant in one of the heat source side heat exchangers. Specifically, as illustrated in an air-conditioning apparatus of FIG. 10 (hereinafter, referred to as an "air-conditioning apparatus 100A(2)"), a heat source side heat exchanger 12 is separated into two heat exchangers (a heat source side heat exchanger 12(1) and a heat source side heat exchanger 12(2)) and they are connected in parallel to each other. In addition, a refrigerant flow blocking device 41(1) and a refrigerant flow blocking device 41(2) are arranged at a point prior to and a point after a refrigerant passage of the heat source side heat exchanger 12(2), and a passage between the heat source side heat exchanger 12(2) and the refrigerant flow blocking device 41(2) is connected to an inlet pipe of an accumulator 19 through an excess refrigerant recovery pipe 42 and an excess refrigerant recovery device 43. Subsequently, AK is controlled as illustrated in FIG. 11.

Figure 11:
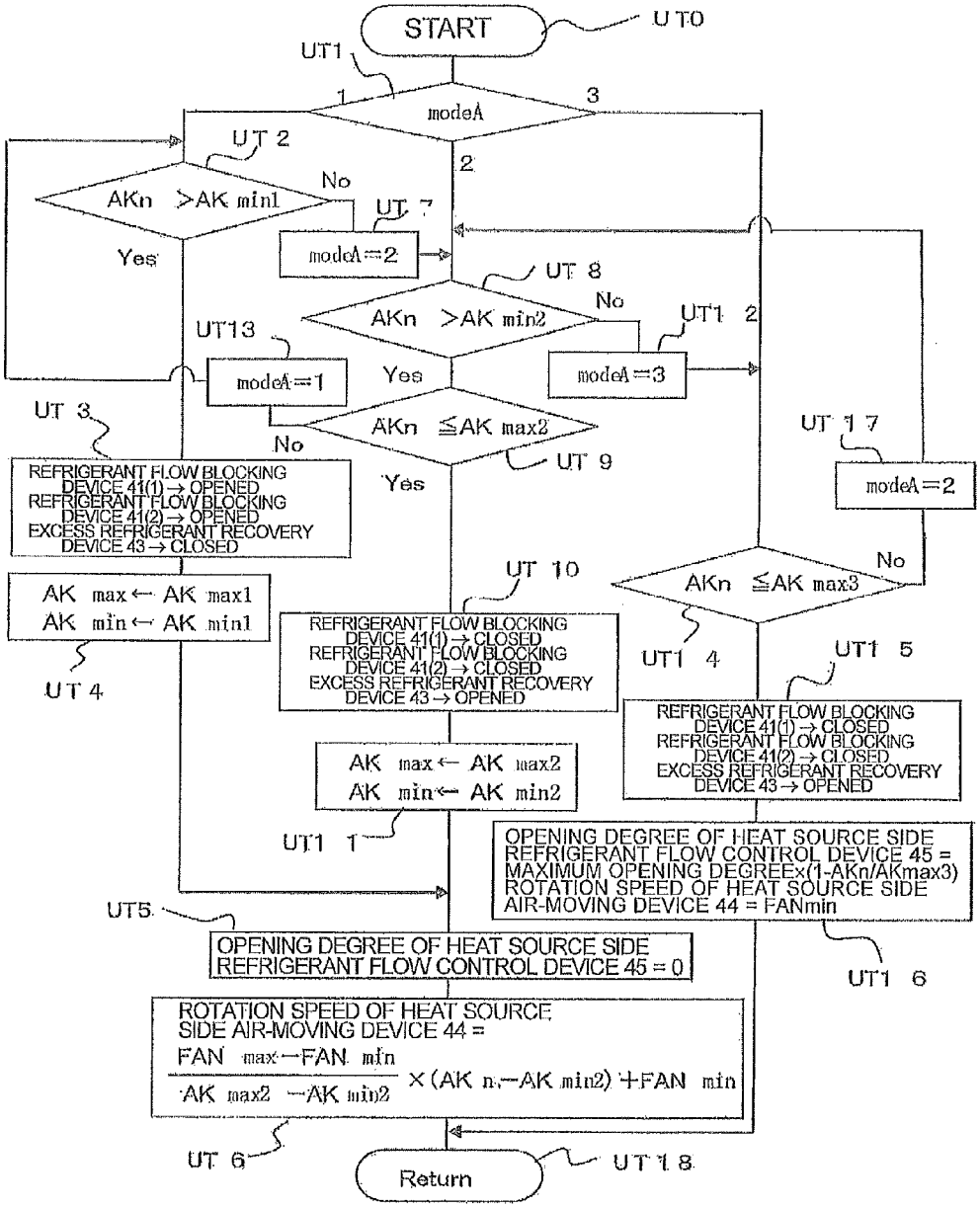
FIG. 11 is a flowchart illustrating a flow of an AK control process by the air-conditioning apparatus according to Embodiment of the invention.

FIG. 11 is a flowchart illustrating a flow of an AK control process by the air-conditioning apparatus 100A(2) according to Embodiment. An exemplary AK control method performed by the air-conditioning apparatus 100A(2) will be described with reference to FIG. 11.

When an operation of the air-conditioning apparatus 100A (2) is started, the controller (not illustrated) starts the AK control process (UT0). First, the controller determines an AK control mode (hereinafter, referred to as a "mode A") (UT1). When determining that mode A is 1 (UT1=1), the controller determines whether AKn is greater than a minimum value AKmin (UT2). When determining that AKn is greater than AKmin (UT2=Yes), the controller fully opens the refrigerant flow blocking device 41(1) and the refrigerant flow blocking device 41(2) and fully closes the excess refrigerant recovery device 43 (UT3), such that the heat source side refrigerant flows into both of the heat source side heat exchanger 12(1) and the heat source side heat exchanger 12(2).

Then, the controller substitutes AKmax1 for AKmax and substitutes AKmin1 for AKmin (UT4). The controller sets the opening degree of the heat source side refrigerant flow control device 45 such that the passage to the heat source side heat exchangers 12 is fully opened and the passage to the bypass pipe 4*c* is fully closed (UT5). After that, the controller controls the heat source side air-sending device 44, controls the capacity of the heat source side heat exchanger 12 on the basis of the above-described Equation (4) (UT6), and then completes the process (UT18).

Whereas, when determining that mode A is 2 (UT1=2), the controller determines whether AKn is greater than AKmin2 (UT8). When determining that AKn is greater than AKmin2 (UT8=Yes), the controller determines whether AKn is smaller than AKmax2 (UT9). When determining that AKn is smaller than AKmax2 (UT9=Yes), the controller closes the refrigerant flow blocking device 41(1) and the refrigerant flow blocking device 41(2) to block passages of the heat source side heat exchanger 12(2), and opens the excess refrigerant recovery device 43 to recover the refrigerant in the heat source side heat exchanger 12(2) into the accumulator 19 through the excess refrigerant recovery pipe 42, such that heat is exchanged between the refrigerant and the air only in the heat source side heat exchanger 12(1) (UT10).

Then, the controller substitutes AKmax2 for AKmax and substitutes AKmin2 for AKmin (UT11). The controller sets the opening degree of the heat source side refrigerant flow control device 45 such that the passage to the heat source side heat exchangers 12 is fully opened and the passage to the bypass pipe 4*c* is fully closed (UT5). After that, the controller controls the heat source side air-sending device 44, controls the capacity of the heat source side heat exchanger 12 (UT6), and then completes the process (UT18).

Whereas, when determining that mode A is 3 (UT1=3), the controller determines whether AKn is smaller than AKmax3 (UT14). When determining that AKn is smaller than AKmax3 (UT14=Yes), the controller closes the refrigerant flow blocking device 41(1) and the refrigerant flow blocking device 41(2) to block the passages of the heat source side heat exchanger 12(2), opens the excess refrigerant recovery device 43 to recover the refrigerant in the heat source side heat exchanger 12(2) into the accumulator 19 through the excess refrigerant recovery pipe 42, such that heat is exchanged between the refrigerant and the air only in the heat source side heat exchanger 12(1) (UT15).

Then, the controller controls the opening degree (opening areas) of the heat source side refrigerant flow control device 45 as expressed by the following Equation (6) to control the capacity of each heat source side heat exchanger 12 (UT16), and then completes the process (UT18).

$$\text{Opening degree of heat source side refrigerant flow control device 45} = \text{maximum opening degree} \times (1 - AKn/AK\text{max3}) \quad \text{Equation (6)}$$

Note that when it is determined in UT2 that AKn is smaller than or equal to the minimum capacity value AKmin1 of each heat source side heat exchanger 12 which can be controlled by the heat source side air-sending device 44, mode A is set to 2 (UT7) and the process proceeds to the determination step in UT8. In addition, if it is determined in UT8 that AKn is smaller than or equal to AKmin2, mode A is set to 3 (UT12) and the process proceeds to the determination step in UT14. Furthermore, if it is determined in UT9 that AKn is greater than AKmax2, mode A is set to 1 (UT13) and the process proceeds to the determination step in UT2. Moreover, if it is determined in UT14 that AKn is greater than AKmax3, mode A is set to 2 (UT17) and the process proceeds to the determination step in UT8.

In FIG. 11, mode A=1 indicates a heat exchange mode (first heat exchange mode) in which heat is exchanged using all of the heat source side heat exchangers 12 and substantially none of the heat source side refrigerant is made to pass through the bypass pipe 14. In addition, mode A=2 indicates a heat exchange mode (second heat exchange mode) in which heat is exchanged using a part of the heat source side heat exchangers 12 and substantially none of the heat source side refrigerant is made to pass through the bypass pipe 14. Moreover, mode A=3 indicates a heat exchange mode (third heat exchange mode) in which heat is exchanged using a part of the heat source side heat exchangers 12 and the ratio of the flow rate of the refrigerant flowing through the heat source heat exchanger 12 to that of the refrigerant flowing through the bypass pipe 14 is controlled.

With the above-described control, in the air-conditioning apparatus 100A(2), the heat source side refrigerant recovered into the accumulator 19 moves inside the refrigerant pipe 4 and is supplied to the outlet side of the heat source side heat exchanger 12, operating as a condenser, to prevent the heat source side refrigerant to be insufficient in the refrigerant circuit and the capacity control to be inappropriate, achieving stable control of AK.

In this case, AKmax1, AKmin1, AKmax2, AKmin2, and AKmax3 are set in descending order such that AKmax1, AKmax2, AKmax3, AKmin1, and AKmin2 are arranged. Furthermore, as regards the values, for example, AKmax1 is 100, AKmax2 is 60, AKmax3 is 40, AKmin1 is 25, and AKmin2 is 20. Alternatively, AKmin2 may be equal to AKmin1.

The case in which the excess refrigerant recovery pipe 42 and the excess refrigerant recovery device 43 are connected between the passage, which is disposed between the heat source side heat exchanger 12(2) and the refrigerant flow blocking device 41(2), and the passage connected to the inlet of the accumulator 19 has been described as an example. They may be arranged so as to connect the passage disposed between the heat source side heat exchanger 12(2) and the refrigerant flow blocking device 41(1) to the passage connected to the inlet of the accumulator 19, or to connect the heat source side heat exchanger 12(1) or the heat source side heat exchanger 12(2) to a passage connected to the inlet of the compressor 10.

Furthermore, each of the refrigerant flow blocking device 41(1), the refrigerant flow blocking device 41(2), and the excess refrigerant recovery device 43 may be an on-off valve, such as a solenoid valve, or a component capable of opening and closing a passage using an electronic stepper motor. Moreover, it is preferred that the heat source side refrigerant flow control device 45 be a component capable of controlling the flow rates by continuously changing each opening area using, for example, an electronic stepper motor. The heat source side refrigerant flow control device 45 may include a plurality of solenoid valves such that a change in opening area is divided into several steps.

The separated heat source side heat exchanger 12 will achieve good controllability when the internal capacities of the two separated heat exchangers are substantially the same. However, the separation is not limited to this case. When the heat exchanger is separated, the internal capacities of the two separated heat exchangers may differ from each other with which no problem will arise.

The case in which the system with the heat exchangers related to heat transfer medium 15 for exchanging heat between the heat source side refrigerant and the heat transfer medium, such as water, has been described as an example. Even in a direct expansion air-conditioning apparatus in which a refrigerant circulates between an outdoor unit and an indoor unit including a heat exchanger related to heat transfer medium which exchanges heat between the heat source side refrigerant and the air, serving as a heat transfer medium, the amount of heat in an outdoor heat exchanger can be controlled in the same manner. Furthermore, even in the case in which the heat source side heat exchanger 12 is a water-cooled heat source system which exchanges heat between the heat transfer medium and the heat source side refrigerant, the heat source side refrigerant flow control device 45 can control the heat amount in the heat source side heat exchanger 12.

Since the air-conditioning apparatus (the air-conditioning apparatus 100 and the air-conditioning apparatus 100A(2)) according to Embodiment operates as described above, the heat amount and the refrigerant amount in the heat source side heat exchanger 12 can be appropriately controlled irrespective of an operation state, thus ensuring an energy-saving operation.

In the air-conditioning apparatus according to Embodiment, in the case in which only the heating load or cooling load is generated in the use side heat exchangers 26, the corresponding first heat transfer medium flow switching devices 22 and the corresponding second heat transfer medium flow switching devices 23 are controlled so as to have a medium opening degree, such that the heat transfer medium flows into both of the heat exchanger related to heat transfer medium 15*a* and the heat exchanger related to heat transfer medium 15*b*. Consequently, since both of the heat exchanger related to heat transfer medium 15*a* and the heat exchanger related to heat transfer medium 15*b* can be used for the heating operation or the cooling operation, the heat transfer area can be increased, and accordingly the heating operation or the cooling operation can be efficiently performed.

In addition, in the case in which the heating load and the cooling load simultaneously occur in the use side heat exchangers 26, the first heat transfer medium flow switching device 22 and the second heat transfer medium flow switching device 23 corresponding to the use side heat exchanger 26 which performs the heating operation are switched to the passage connected to the heat exchanger related to heat transfer medium 15*b* for heating, and the first heat transfer medium flow switching device 22 and the second heat transfer medium flow switching device 23 corresponding to the use side heat exchanger 26 which performs the cooling operation are switched to the passage connected to the heat exchanger related to heat transfer medium 15*a* for cooling, so that the heating operation or cooling operation can be freely performed in each indoor unit 2.

Furthermore, each of the first heat transfer medium flow switching devices 22 and the second heat transfer medium flow switching devices 23 described in Embodiment may be any of the sort as long as it can switch passages, for example, a three-way valve capable of switching between three passages or a combination of two on-off valves and the like switching between two passages. Alternatively, components such as stepper-motor-driven mixing valve capable of changing flow rates of three passages or electronic expansion valves capable of changing flow rates of two passages may be used in combination as each of the first heat transfer medium flow switching devices 22 and the second heat transfer medium flow switching devices 23. In this case, water hammer caused when a passage is suddenly opened or closed can be prevented. Furthermore, while Embodiment has been described with respect to the case in which the heat transfer medium flow control devices 25 each include a two-way valve, each of the heat transfer medium flow control devices 25 may include a control valve having three passages and the valve may be disposed with a bypass pipe that bypasses the corresponding use side heat exchanger 26.

Furthermore, as regards each of the heat transfer medium flow control device 25, a stepper-motor-driven type that is capable of controlling a flow rate in a passage may be used. Alternatively, a two-way valve or a three-way valve whose one end is closed may be used. Alternatively, as regards each of the heat transfer medium flow control device 25, a component, such as an on-off valve, which is capable of opening or closing a two-way passage, may be used while ON and OFF operations are repeated to control an average flow rate.

Furthermore, while each second refrigerant flow switching device 18 is illustrated as a two-way flow switching valve, the device is not limited to this valve. A plurality of three-way flow switching valves may be used such that the refrigerant flows in the same manner. In addition, each second refrigerant flow switching device 18 may include a four-way valve.

While the air-conditioning apparatus according to Embodiment has been described with respect to the case in which the apparatus can perform the cooling and heating mixed operation, the apparatus is not limited to the case. For example, even in an apparatus that is configured by a single heat exchanger related to heat transfer medium 15 and a single expansion device 16 that are connected to a plurality of parallel use side heat exchangers 26 and heat transfer medium flow control devices 25, and is capable of carrying out only a cooling operation or a heating operation, the same advantages can obtained.

In addition, it is needless to say that the same holds true for the case in which a single use side heat exchanger 26 and a single heat transfer medium flow control device 25 are connected. Moreover, obviously, no problem will arise even if the heat exchanger related to heat transfer medium 15 and the expansion device 16 acting in the same manner are arranged in plural numbers. Furthermore, while the case in which the heat transfer medium flow control devices 25 are arranged in the heat transfer medium relay unit 3 has been described, the arrangement is not limited to this case. Each heat transfer medium flow control device 25 may be disposed in the indoor unit 2. The heat transfer medium relay unit 3 may be separated from the indoor unit 2.

As regards the heat source side refrigerant, a single refrigerant, such as R-22 or R-134a, a near-azeotropic refrigerant mixture, such as R-410A or R-404A, a non-azeotropic refrigerant mixture, such as R-407C, a refrigerant, such as $CF_3CF{=}CH_2$, containing a double bond in its chemical formula and having a relatively low global warming potential, a mixture containing the refrigerant, or a natural refrigerant, such as $CO_2$ or propane, can be used. While the heat exchanger related to heat transfer medium 15*a* or the heat exchanger related to heat transfer medium 15*b* is operating for heating, a refrigerant that typically changes between two phases is condensed and liquefied and a refrigerant that turns into a supercritical state, such as $CO_2$, is cooled in the supercritical state. As for the rest, either of the refrigerant acts in the same manner and offers the same advantages.

As regards the heat transfer medium, for example, brine (antifreeze), water, a mixed solution of brine and water, or a mixed solution of water and an additive with high anticorrosive effect can be used. In the air-conditioning apparatus 100, therefore, even if the heat transfer medium leaks into the indoor space 7 through the indoor unit 2, because the heat transfer medium used is high in its safety, contribution to improvement of safety can be made.

Typically, a heat source side heat exchanger 12 and a use side heat exchanger 26 are each provided with an air-sending device and a current of air often facilitates condensation or evaporation. The structure is not limited to this case. For example, a heat exchanger, such as a panel heater, using radiation can be used as the use side heat exchanger 26 and a water-cooled heat exchanger which transfers heat using water or antifreeze can be used as the heat source side heat exchanger 12. In other words, as long as the heat exchanger is configured to be capable of transferring heat or removing heat, any type of heat exchanger can be used as each of the heat source side heat exchanger 12 and the use side heat exchanger 26.

While Embodiment has been described with respect to the case in which the number of use side heat exchangers 26 is four, the number of the use side heat exchangers is not especially limited. In addition, while Embodiment has been described with respect to the case in which two heat exchangers related to heat transfer medium are arranged, namely, heat exchanger related to heat transfer medium 15*a* and the heat exchanger related to heat transfer medium 15*b*, it goes without saying that the arrangement is not limited to this case. As long as the heat exchanger related to heat transfer medium 15 is configured to be capable of cooling or/and heating the heat transfer medium, the number of heat exchangers related to heat transfer medium 15 arranged is not limited. Furthermore, as regards each of the pump 21*a* and the pump 21*b*, the number of pumps is not limited to one. A plurality of pumps having a small capacity may be connected in parallel.

Furthermore, each of the first heat transfer medium flow switching devices 22 and the second heat transfer medium flow switching devices 23 described in Embodiment may be any of the sort as long as it can switch passages, for example, a three-way valve capable of switching between three passages or a combination of two on-off valves and the like switching between two passages. Alternatively, components such as stepper-motor-driven mixing valve capable of changing flow rates of three passages or electronic expansion valves capable of changing flow rates of two passages may be used in combination as each of the first heat transfer medium flow switching devices 22 and the second heat transfer medium flow switching devices 23. In this case, water hammer caused when a passage is suddenly opened or closed can be prevented. Furthermore, while Embodiment has been described with respect to the case in which the heat transfer medium flow control devices 25 each include a stepper-motor-driven two-way valve, each of the heat transfer medium flow control devices 25 may include a control valve having three passages and the valve may be disposed with a bypass pipe that bypasses the corresponding use side heat exchanger 26.

Furthermore, as regards each of the heat transfer medium flow control device 25, a stepper-motor-driven type that is capable of controlling a flow rate in a passage may be used. Alternatively, a two-way valve or a three-way valve whose one end is closed may be used. Alternatively, as regards each of the heat transfer medium flow control device 25, a component, such as an on-off valve, which is capable of opening or closing a two-way passage, may be used while ON and OFF operations are repeated to control an average flow rate.

Furthermore, while the case in which each second refrigerant flow switching device 18 is a four-way valve has been described, the device is not limited to this type. The device may be configured such that the refrigerant flows in the same manner using a plurality of two-way flow switching valves or three-way flow switching valves.

While the air-conditioning apparatus 100 according to Embodiment has been described with respect to the case in which the apparatus can perform the cooling and heating mixed operation, the apparatus is not limited to the case. Even in an apparatus that is configured by a single heat exchanger related to heat transfer medium 15 and a single expansion device 16 that are connected to a plurality of parallel use side heat exchangers 26 and heat transfer medium flow control devices 25, and is capable of carrying out only a cooling operation or a heating operation, the same advantages can obtained.

In addition, it is needless to say that the same holds true for the case in which a single use side heat exchanger 26 and a single heat transfer medium flow control device 25 are connected. Moreover, obviously, no problem will arise even if the heat exchanger related to heat transfer medium 15 and the expansion device 16 acting in the same manner are arranged in plural numbers. Furthermore, while the case in which the heat transfer medium flow control devices 25 are arranged in the heat transfer medium relay unit 3 has been described, the arrangement is not limited to this case. Each heat transfer medium flow control device 25 may be disposed in the indoor unit 2. The heat transfer medium relay unit 3 may be separated from the indoor unit 2.

As regards the heat source side refrigerant, a single refrigerant, such as R-22 or R-134a, a near-azeotropic refrigerant mixture, such as R-410A or R-404A, a non-azeotropic refrigerant mixture, such as R-407C, a refrigerant, such as $CF_3CF{=}CH_2$, containing a double bond in its chemical formula and having a relatively low global warming potential, a mixture containing the refrigerant, or a natural refrigerant, such as $CO_2$ or propane, can be used. While the heat exchanger related to heat transfer medium 15*a* or the heat exchanger related to heat transfer medium 15*b* is operating for heating, a refrigerant that typically changes between two phases is condensed and liquefied and a refrigerant that turns into a supercritical state, such as $CO_2$, is cooled in the supercritical state. As for the rest, either of the refrigerant acts in the same manner and offers the same advantages.

As regards the heat transfer medium, for example, brine (antifreeze), water, a mixed solution of brine and water, or a mixed solution of water and an additive with high anticorrosive effect can be used. In the air-conditioning apparatus 100, therefore, even if the heat transfer medium leaks into the indoor space 7 through the indoor unit 2, because the heat transfer medium used is high in its safety, contribution to improvement of safety can be made.

While Embodiment has been described with respect to the case in which the air-conditioning apparatus 100 includes the accumulator 19, the accumulator 19 may be omitted. In addition, while Embodiment has been described with respect to the case in which the air-conditioning apparatus 100 includes the check valves 13*a* to 13*d*, these components are not essential parts. It is therefore needless to say that even if the accumulator 19 and the check valves 13*a* to 13*d* are omitted, the air-conditioning apparatus will act in the same manner and offer the same advantages.

Typically, a heat source side heat exchanger 12 and a use side heat exchanger 26 are each provided with an air-sending device and a current of air often facilitates condensation or evaporation. The structure is not limited to this case. For example, a heat exchanger, such as a panel heater, using radiation can be used as the use side heat exchanger 26 and a water-cooled heat exchanger which transfers heat using water or antifreeze can be used as the heat source side heat exchanger 12. In other words, as long as the heat exchanger is configured to be capable of transferring heat or removing heat, any type of heat exchanger can be used as each of the heat source side heat exchanger 12 and the use side heat exchanger 26. The number of use side heat exchanger 26 is not particularly limited.

Embodiment has been described with respect to the case in which the single first heat transfer medium flow switching device 22, the single second heat transfer medium flow switching device 23, and the single heat transfer medium flow control device 25 are connected to each use side heat exchanger 26. The arrangement is not limited to this case. A plurality of devices 22, a plurality of devices 23, and a plurality of devices 25 may be connected to each use side heat exchanger 26. In this case, the first heat transfer medium flow switching devices, the second heat transfer medium flow switching devices, and the heat transfer medium flow control devices connected to the same use side heat exchanger 26 may be operated in the same manner.

Furthermore, Embodiment has been described with respect to the case in which the number of heat exchangers related to heat transfer medium 15 is two. As a matter of course, the arrangement is not limited to this case. As long as the heat exchanger related to heat transfer medium 15 is configured to be capable of cooling or/and heating the heat transfer medium, the number of heat exchangers related to heat transfer medium 15 arranged is not limited.

Furthermore, each of the number of pumps 21*a* and that of pumps 21*b* is not limited to one. A plurality of pumps having a small capacity may be used in parallel.

As described above, the air-conditioning apparatus according to Embodiment can perform a safe and high energy-saving operation by controlling the heat transfer medium flow switching devices (the first heat transfer medium flow switching devices 22 and the second heat transfer medium flow switching devices 23), the heat transfer medium flow control devices 25, and the pumps 21 for the heat transfer medium.

REFERENCE SIGNS LIST

1 outdoor unit; 2 indoor unit; 2*a* indoor unit; 2*b* indoor unit; 2*c* indoor unit; 2*d* indoor unit; 3 heat transfer medium relay unit; 3*a* main heat transfer medium relay unit; 3*b* sub heat transfer medium relay unit; 4 refrigerant pipe; 4*a* first connecting pipe; 4*b* second connecting pipe; 4*c* bypass pipe; 5 pipe; 6 outdoor space; 7 indoor space; 8 space; 9 structure; 10 compressor; 11 first refrigerant flow switching device; 12 heat source side heat exchanger; 13*a* check valve; 13*b* check valve, 13*c* check valve; 13*d* check valve; 14 gas-liquid separator; 15 heat exchanger related to heat transfer medium; 15*a* heat exchanger related to heat transfer medium; 15*b* heat exchanger related to heat transfer medium; 16 expansion device; 16*a* expansion device; 16*b* expansion device; 16*c* expansion device; 17 opening and closing device; 17*a* opening and closing device; 17*b* opening and closing device; 18 second refrigerant flow switching device; 18*a* second refrigerant flow switching device; 18*b* second refrigerant flow switching device; 19 accumulator; 21 pump; 21*a* pump; 21*b* pump; 22 first heat transfer medium flow switching device; 22*a* first heat transfer medium flow switching device; 22*b* first heat transfer medium flow switching device; 22*c* first heat medium flow switching device; 22*d* first heat transfer medium flow switching device; 23 second heat transfer medium flow switching device; 23*a* second heat transfer medium flow switching device; 23*b* second heat transfer medium flow switching device; 23*c* second heat transfer medium flow switching device; 23*d* second heat transfer medium flow switching device; 25 heat transfer medium flow control device; 25*a* heat transfer medium flow control device; 25*b* heat transfer medium flow control device; 25*c* heat transfer medium flow control device; 25*d* heat transfer medium flow control device; 26 use side heat exchanger; 26*a* use side heat exchanger; 26*b* use side heat exchanger; 26*c* use side heat exchanger; 26*d* use side heat exchanger; 31 first temperature sensor; 31*a* first temperature sensor; 31*b* first temperature sensor; 34 second temperature sensor; 34*a* second temperature sensor; 34*b* second temperature sensor; 34*c* second temperature sensor; 34*d* second temperature sensor; 35 third temperature sensor; 35*a* third temperature sensor; 35*b* third temperature sensor; 35*c* third temperature sensor; 35*d* third temperature sensor; 36 pressure sensor; 41 refrigerant flow blocking device; 42 excess refrigerant recovery pipe; 43 excess refrigerant recovery device; 44 heat source side air-sending device; 45 heat source side refrigerant flow control device; 46 flow switching unit; 47 flow switching unit; 100 air-conditioning apparatus; 100A(1) air-conditioning apparatus; 100A(2) air-conditioning apparatus; A refrigerant circuit; and B heat transfer medium cycle.

The invention claimed is:

1. An air-conditioning apparatus that forms a refrigerant circuit connecting a compressor; at least two heat source side heat exchangers connected in parallel; a plurality of expansion devices; and refrigerant passages of a plurality of heat exchangers related to heat transfer medium that exchange heat between a heat source side refrigerant and a heat transfer medium, the refrigerant circuit circulating the heat source side refrigerant, wherein the refrigerant circuit includes a bypass pipe that connects a point prior to and a point after the at least two heat source side heat exchangers to bypass the heat source side heat exchangers, a heat source side refrigerant flow control device configured to close either the passage of the heat source side refrigerant flowing through the heat source side heat exchangers or the passage of the refrigerant flowing through the bypass pipe while opening the other passage simultaneously, a first refrigerant flow blocking device disposed at an inlet of at least one of the heat source side heat exchangers, a second refrigerant flow blocking device disposed at an outlet of the at least one of the heat source side heat exchangers, an excess refrigerant recovery pipe connected between the inlet of the at least one of the heat source side heat exchangers and the first refrigerant flow blocking device or between the outlet of the at least one of the heat source side heat exchangers and the second refrigerant flow blocking device, to a passage connected to a suction side of the compressor, and an excess refrigerant recovery device disposed in the excess refrigerant recovery pipe.

2. The air-conditioning apparatus of claim 1, wherein the majority of the heat source side refrigerant flowing through the refrigerant circuit is allowed to pass through the heat source side refrigerant flow control device.

3. The air-conditioning apparatus of claim 1, wherein the heat source side refrigerant flow control device is a three-way flow control device or a plurality of two-way flow control devices.

4. The air-conditioning apparatus of claim 1, further comprising:

a heat source side air-sending device that supplies air to the heat source side heat exchanger, wherein control of the rotation speed of the heat source side air-sending device and control of the heat source side refrigerant flow rate using the heat source side refrigerant flow control device are jointly performed.

5. The air-conditioning apparatus of claim 4, wherein when a necessary amount of heat to be exchanged in the heat source side heat exchanger is greater than a predetermined value, the control of the rotation speed of the heat source side air-sending device is performed preferentially over the control of the heat source side refrigerant flow rate using the heat source side refrigerant flow control device, and when the necessary amount of heat to be exchanged in the heat source side heat exchanger is smaller than the predetermined value, the control of heat source side refrigerant flow rate using the heat source side refrigerant flow control device is performed preferentially over the control of the rotation speed of the heat source side air-sending device.

6. The air-conditioning apparatus of claim 1, wherein the apparatus has:

a first heat exchange mode in which heat is exchanged using all of the heat source side heat exchangers and substantially none of the heat source side refrigerant is allowed to pass through the bypass pipe;

a second heat exchange mode in which heat is exchanged using at least one of the heat source side heat exchangers and substantially none of the heat source side refrigerant is allowed to pass through the bypass pipe; and a third heat exchange mode in which heat is exchanged using at least one of the heat source side heat exchangers and the ratio of the flow rate of the heat source side refrigerant flowing through at least one of the heat source side heat exchangers to that of the heat source side refrigerant flowing through the bypass pipe is controlled, and the refrigerant flow blocking devices are opened and the excess refrigerant recovery device is closed in the first heat exchange mode.

7. The air-conditioning apparatus of claim 1, wherein the apparatus has:

a first heat exchange mode in which heat is exchanged using all of the heat source side heat exchangers and substantially none of the heat source side refrigerant is allowed to pass through the bypass pipe;

a second heat exchange mode in which heat is exchanged using at least one of the heat source side heat exchangers and substantially none of the heat source side refrigerant is allowed to pass through the bypass pipe; and a third heat exchange mode in which heat is exchanged using at least one of the heat source side heat exchangers and the ratio of the flow rate of the heat source side refrigerant flowing through at least one of the heat source side heat exchangers to that of the heat source side refrigerant flowing through the bypass pipe is controlled, and the refrigerant flow blocking devices are closed and the excess refrigerant recovery device is opened in the second heat exchange mode and the third heat exchange mode.

8. The air-conditioning apparatus of claim 1, wherein the capacities of the heat source side heat exchangers are substantially the same.

9. The air-conditioning apparatus of claim 1, further comprising:

a plurality of heat transfer medium delivery devices; and a plurality of use side heat exchangers that exchange heat between the heat transfer medium and air in respective conditioned spaces, wherein the heat transfer medium delivery devices and the use side heat exchangers are connected to heat transfer medium passages of the heat exchangers related to heat transfer medium to form a plurality of heat medium cycles, a use side flow control device that controls the amount of the heat transfer medium circulated in the use side heat exchanger is disposed on the inlet side or an outlet side of each of the use side heat exchangers, and a heat transfer medium flow switching device switching passages of the heat transfer medium is disposed on each of the inlet sides and the outlet sides of the use side heat exchangers.

10. The air-conditioning apparatus of claim 9, wherein the compressor and the heat source side heat exchanger are housed in an outdoor unit, the expansion devices, the heat exchangers related to heat transfer medium, and the pumps are housed in a heat transfer medium relay unit, each use side heat exchanger is housed in an indoor unit, and the indoor units, the heat transfer medium relay unit, and the outdoor unit are separated from one another such that they are allowed to be arranged at separate positions.

11. The air-conditioning apparatus of claim 10, wherein the outdoor unit is connected to the heat transfer medium relay unit through at least two refrigerant pipes and the heat transfer medium relay unit is connected to each indoor unit through two heat transfer medium pipes.

12. The air-conditioning apparatus of claim 1, wherein the heat source side refrigerant flow control device is configured to control the ratio of the flow rate of the heat source side refrigerant flowing through the heat source side heat exchanger and the flow rate of the refrigerant flowing through the bypass pipe.

* * * * *